US010191444B2

(12) United States Patent
Kikuchi et al.

(10) Patent No.: US 10,191,444 B2
(45) Date of Patent: Jan. 29, 2019

(54) IMAGE FORMING APPARATUS WHICH INCLUDES A DETACHABLE CARTRIDGE CONFIGURED TO AVOID A COLLISION BETWEEN AN EXPOSING MEMBER AND THE CARTRIDGE WHEN MOUNTING THE CARTRIDGE TO A SUPPORTING MEMBER OF THE IMAGE FORMING APPARATUS

(71) Applicant: CANON KABUSHIKI KAISHA, Tokyo (JP)

(72) Inventors: Ken Kikuchi, Mishimi (JP); Tsutomu Nishiuwatoko, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/247,401

(22) Filed: Aug. 25, 2016

(65) Prior Publication Data

US 2017/0060081 A1 Mar. 2, 2017

(30) Foreign Application Priority Data

Aug. 31, 2015 (JP) ..... 2015-169954
Aug. 31, 2015 (JP) ..... 2015-169955
Jun. 28, 2016 (JP) ..... 2016-127170

(51) Int. Cl.
*G03G 21/16* (2006.01)

(52) U.S. Cl.
CPC ..... *G03G 21/1647* (2013.01); *G03G 21/1623* (2013.01); *G03G 21/1666* (2013.01);
(Continued)

(58) Field of Classification Search
CPC ..... G03G 21/1647; G03G 21/1623; G03G 21/1666; G03G 21/1671; G03G 21/1846
See application file for complete search history.

(56) References Cited

U.S. PATENT DOCUMENTS

2012/0195627 A1* 8/2012 Kikuchi ..... G03G 21/1647 399/110
2012/0237255 A1* 9/2012 Souda ..... G03G 21/1633 399/114

(Continued)

FOREIGN PATENT DOCUMENTS

JP 2004125954 A 4/2004
JP 2004279689 A 10/2004

(Continued)

OTHER PUBLICATIONS

English translation of Description to JP 2009-157135.*

*Primary Examiner* — Arlene Heredia Ocasio
(74) *Attorney, Agent, or Firm* — Canon USA, Inc. I.P. Division

(57) ABSTRACT

In an image forming apparatus, a guide portion provided to a supporting member, engages a cartridge and guides the cartridge, to move the cartridge toward a mounting portion. A regulated portion provided to a frame, and a regulating portion provided to the supporting member, regulates the position of the regulated portion when the cartridge is at a position not engaged with the guide portion. The supporting member is configured with an upstream side of a light emitting surface being opened with regard to mounting the cartridge to the mounting portion in the mounting direction. A gap is formed between the frame and the light emitting surface when the regulated portion is in contact with the regulating portion and the position of the regulated portion is being regulated.

7 Claims, 20 Drawing Sheets

(52) U.S. Cl.
CPC . *G03G 21/1671* (2013.01); *G03G 2221/1684* (2013.01); *G03G 2221/1869* (2013.01)

(56) References Cited

U.S. PATENT DOCUMENTS

| | | | | |
|---|---|---|---|---|
| 2014/0241755 | A1* | 8/2014 | Kikuchi | G03G 21/1647 399/111 |
| 2015/0362890 | A1* | 12/2015 | Komatsu | G03G 21/1676 399/110 |

FOREIGN PATENT DOCUMENTS

| | | | |
|---|---|---|---|
| JP | 2004301944 | A | 10/2004 |
| JP | 2008158381 | A | 7/2008 |
| JP | 2009157135 | A | 7/2009 |
| JP | 2010078721 | A | 4/2010 |
| JP | 2012194396 | A | 10/2012 |
| JP | 2012208362 | A | 10/2012 |
| JP | 2013003208 | A | 1/2013 |
| JP | 2014016484 | A | 1/2014 |
| JP | 2014066797 | A | 4/2014 |

* cited by examiner

IMAGE FORMING APPARATUS WHICH INCLUDES A DETACHABLE CARTRIDGE CONFIGURED TO AVOID A COLLISION BETWEEN AN EXPOSING MEMBER AND THE CARTRIDGE WHEN MOUNTING THE CARTRIDGE TO A SUPPORTING MEMBER OF THE IMAGE FORMING APPARATUS

BACKGROUND OF THE INVENTION

Field of the Invention

The present invention relates to an image forming apparatus having a detachable cartridge.

Description of the Related Art

There has conventionally been known a cartridge system image forming apparatus that uses electrophotographic image forming process, in which a photosensitive drum and a developing unit accommodating a developing roller that acts on the photosensitive drum and a developing agent (toner) are integrally formed.

There is also known a developing cartridge type system, that is configured just of a developing unit, separately from the photosensitive drum. According to these cartridge systems, maintenance of the image forming apparatus can be performed by the user him/herself, without having to depend on a field engineer for service.

Accordingly, these cartridge systems are in widespread use in electrophotographic image forming apparatuses.

There also is known a technology configured where a supporting member detachably supporting a cartridge is provided, and exchanging work of cartridges can be performed by extracting the supporting member from within the main unit of the electrophotographic image forming apparatus to a predetermined position. According to this technology, the user can easily perform replacement of developing agent.

Japanese Patent Laid-Open No. 2009-157135 describes providing an image exposing member, that exposes the surface of the photosensitive drum and forms an electrostatic latent image, on a supporting member detachably supporting a cartridge. This proposes a technology to realize both reduction in retracting space of the image exposing member and ease of work of cartridge replacement by the user.

However, in the technology in Japanese Patent Laid-Open No. 2009-157135, if the user erroneously attempts to mount a cartridge in a supporting member at a position different from the correct mounting position, there is a risk of the image exposing member and a frame making up the cartridge colliding. This can damage the image exposing member, and obstruct image forming.

Also, in the technology in Japanese Patent Laid-Open No. 2009-157135, the user mounts the cartridge into the supporting member by sliding a rotating shaft of the cartridge along a guide groove within the supporting member. In a case where the user performs an action of rotating the cartridge on the rotating shaft, there is a risk of the cartridge and image exposing member colliding.

It has been found to be advantageous to avoid collision between an image exposing member and cartridge when mounting the cartridge within a supporting member having the image exposing member.

SUMMARY OF THE INVENTION

An image forming apparatus according to an aspect of the present invention includes a cartridge having at least an image bearing member and a frame; a supporting member configured to move between an inside position situated inside a main unit of the image forming apparatus in a state of supporting the cartridge, and an outside position situated outside of the main unit of the image forming apparatus; a mounting portion provided to the supporting member, to which the cartridge is mountable from a direction orthogonal to an axial direction of the image bearing member; an image exposing member provided to the mounting portion, configured to form a latent image on the image bearing member by emitting light from a light emitting surface toward the image bearing member; a guide portion provided to the supporting member, configured to engage the cartridge and guide the cartridge, to move the cartridge toward the mounting portion; and a regulating portion provided to the supporting member, configured to regulate the position of the regulated portion when the cartridge is at a position not engaged with the guide portion. The supporting member is configured with an upstream side of the light emitting surface being opened with regard to mounting the cartridge to the mounting portion in the mounting direction, and a gap is formed between the frame and the light emitting surface when the regulated portion is in contact with the regulating portion and the position of the regulated portion is being regulated.

An image forming apparatus according to another aspect of the present invention includes a cartridge having a frame; a supporting member configured to move between an inside position situated inside a main unit of the image forming apparatus in a state of supporting the cartridge, and an outside position situated outside of the main unit of the image forming apparatus; a mounting portion provided to the supporting member, to which the cartridge is mountable from a direction orthogonal to a longitudinal direction; an image exposing member provided to the mounting portion, configured to form a latent image on the image bearing member; a rotation-regulated portion provided to the frame; and a rotation regulating portion provided to the mounting portion, configured to abut the rotation-regulated portion and position the rotational posture of the cartridge. After the rotation-regulated portion is regulated by the rotation regulating portion at the time of mounting the cartridge to the mounting portion, the frame and the image exposing member begin to overlap in the mounting direction of the cartridge.

Further embodiments, features and aspects of the present invention will become apparent from the following description of exemplary embodiments with reference to the attached drawings.

DESCRIPTION OF THE EMBODIMENTS

Various embodiments, features and aspects of the present invention will be described in detail with reference to the drawings.

First Embodiment

A first embodiment of the image forming apparatus according to the present invention will be described with reference to FIGS. 1 through 14.

Image Forming Apparatus

Figure 1:
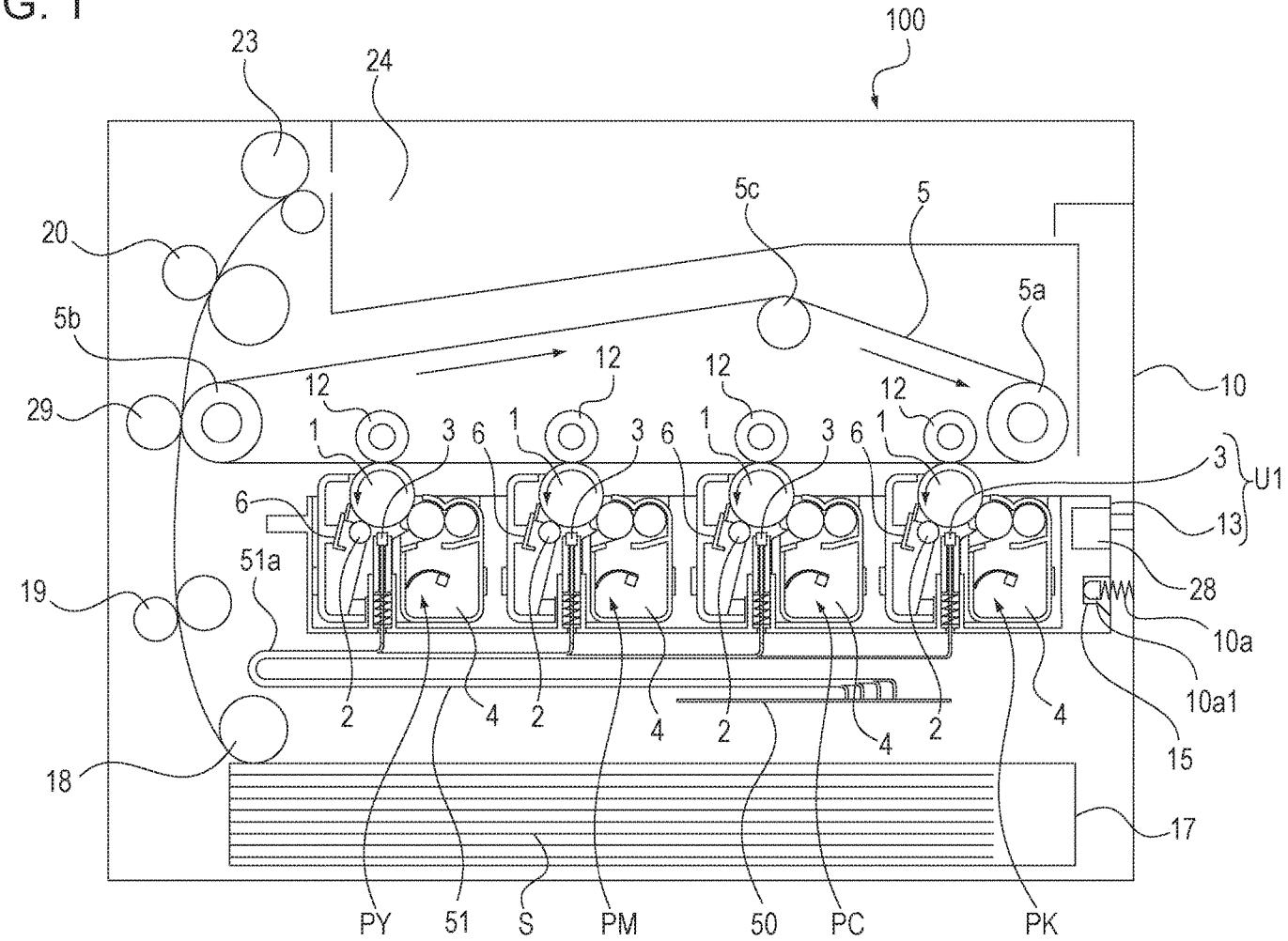
FIG. 1 is a cross-sectional explanatory diagram illustrating the configuration of an image forming apparatus.
Figure 2:
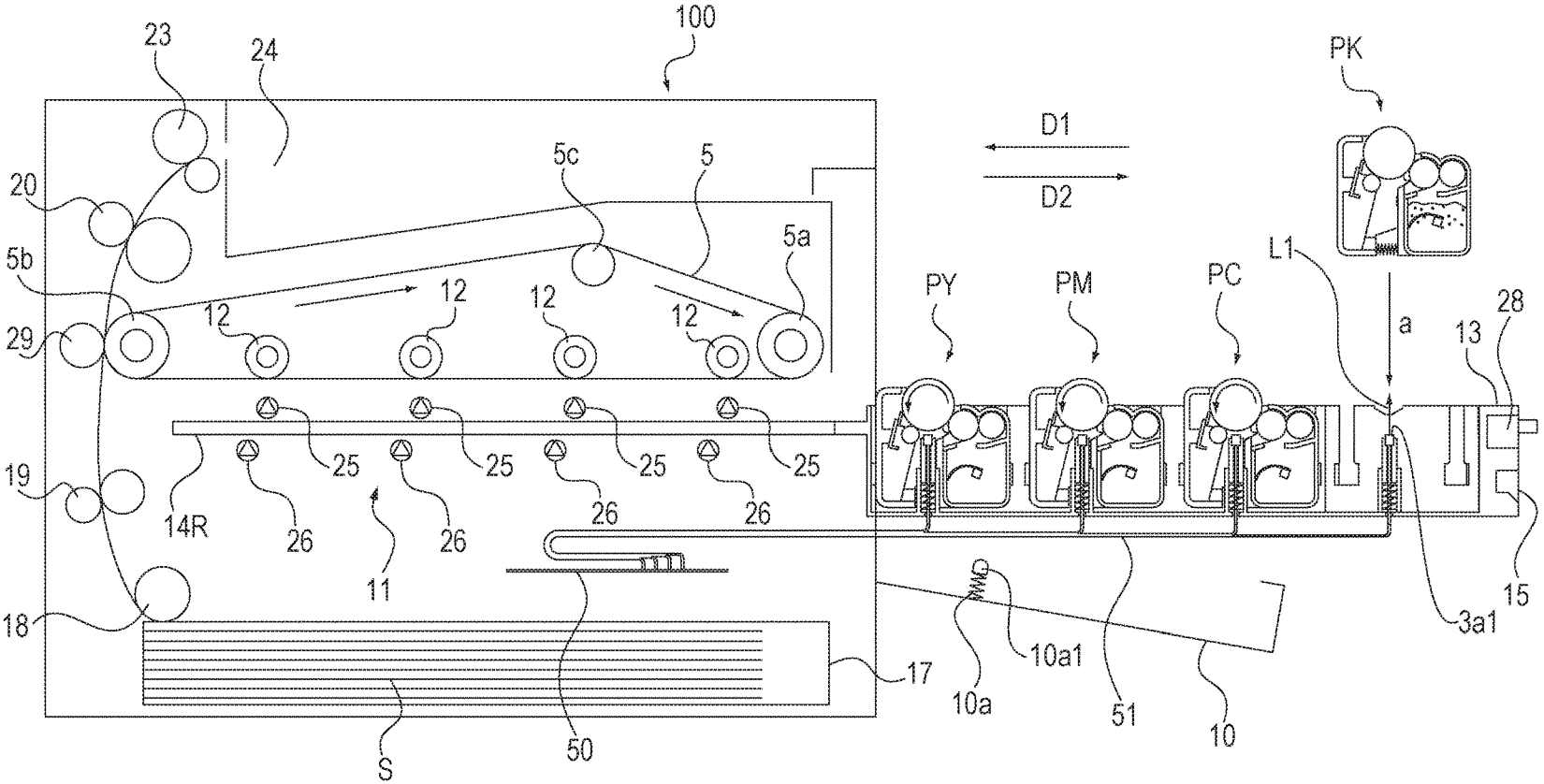
FIG. 2 is a cross-sectional explanatory diagram illustrating extracting a supporting member from a main unit of the image forming apparatus and mounting cartridges.

FIG. 1 is a cross-sectional explanatory diagram illustrating the configuration of an image forming apparatus 100 according to the present embodiment. FIG. 2 is a cross-sectional explanatory diagram illustrating a state where an extracting member 13 serving as a supporting member has been extracted from the image forming apparatus 100 main unit.

The image forming apparatus 100 main unit according to the present embodiment has process cartridges (hereinafter may be referred to simply as "cartridges") of the colors yellow (Y), magenta (M), cyan (C), and black (K), as PY, PM, PC, and PK, respectively, arrayed in the horizontal direction which is the left-right direction in FIG. 1. The process cartridges P for these colors are mounted and detached in the vertical direction in FIG. 2 (the direction indicated by arrows a).

The process cartridges PY, PM, PC, and PK may be described simply as process cartridge P, for the sake of brevity of description. This is true for other image forming process units as well.

Each process cartridge P has a photosensitive drum 1 serving as an image bearing member made up of an electrophotographic photosensitive member that is rotatably provided. Each photosensitive drum 1 is configured to be rotated in the counterclockwise direction in FIG. 1, by a drive unit such as a motor or the like that is omitted from illustration.

The image forming apparatus 100 is provided with a charging roller 2 serving as a charging unit besides the photosensitive drum 1, as an electrophotographic image forming process unit. Further provided is an LED (light emitting diode) unit 3 serving as an image exposing member.

Moreover, there are provided a developing unit 4, an intermediate transfer belt 5 serving as a transfer member, a primary transfer roller 12 serving as a primary transfer unit, and so forth. The charging roller 2 uniformly charges the surface of the photosensitive drum 1.

Figure 8:
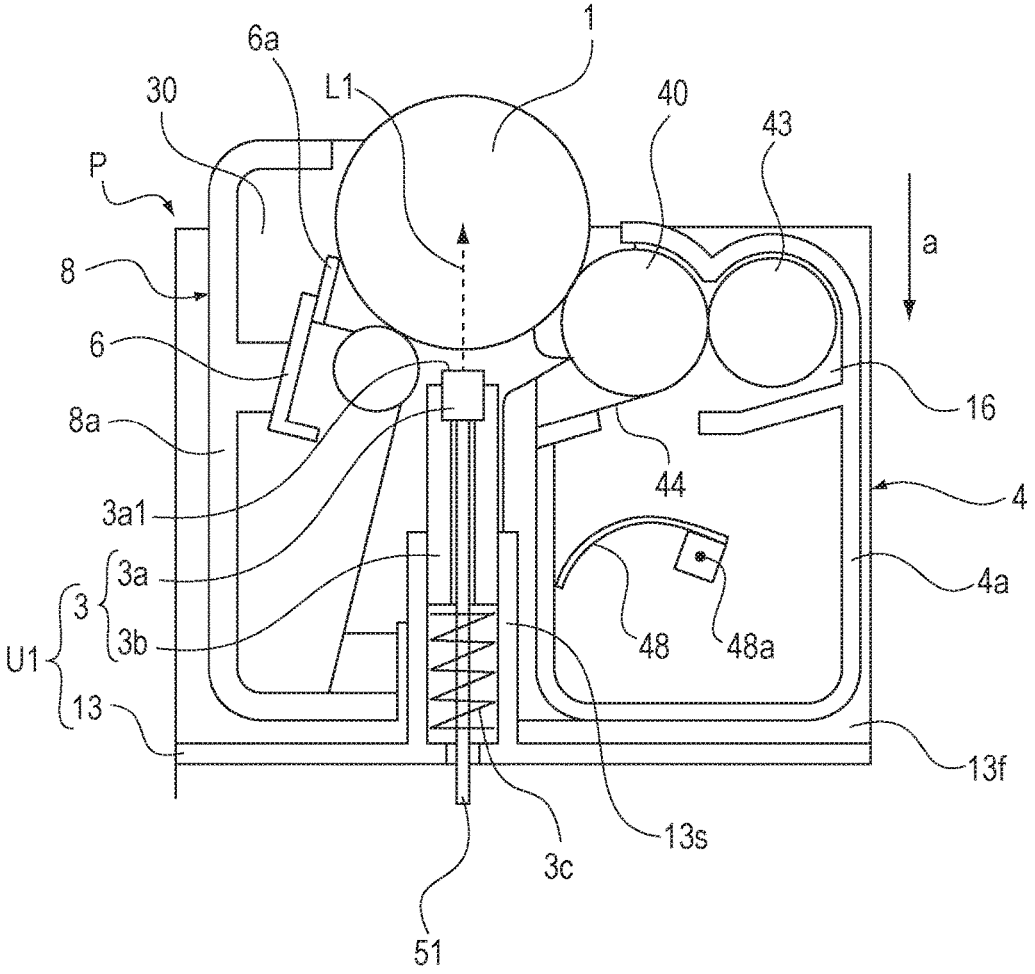
FIG. 8 is a cross-sectional explanatory diagram illustrating mounting a cartridge to the mounting portion of the supporting member.

The LED unit 3 serving as the image exposing member is configured having an LED head 3*a* and a supporting member 3*b* that fixes and supports the LED head 3*a*, as illustrated in FIG. 8. The LED unit 3 further is configured having a biasing member 3*c* formed of a coil spring that urges the LED head 3*a* and supporting member 3*b* toward the surface of the photosensitive drum 1, and having other members as well.

The LED head 3*a* is disposed below the photosensitive drum 1, so as to face the surface of the photosensitive drum 1, as illustrated in FIG. 8. The LED head 3*a* has multiple LEDs serving as light emitting elements disposed facing the photosensitive face of the photosensitive drum 1, from one end to the other in the axis direction of the photosensitive drum 1. The multiple LEDs are capable of independently emitting light, and are arrayed in the axial direction of the photosensitive drum 1. Light emitted from the LEDs passes through unshown lenses provided to the LED head 3*a*, passes through a light emitting surface 3*a*1, and is emitted outwards from the LED head 3*a*. The light emitting surface 3*a*1 is situated at the topmost portion of the LED head 3*a*, and a vector L1 of the normal direction of the light emitting surface 3*a*1 includes a vertical upwards direction component. The normal direction vector L1 matches the emission direction of light emitted from the LED head 3*a* toward the photosensitive drum 1. The LEDs emit light by signals emitted by a control unit mounted on a control board 50 illustrated in FIG. 1, forming an electrostatic latent image on the surface of the photosensitive drum 1 uniformly changed by the charging roller 2, in accordance with image information.

Although description is made in the present embodiment regarding a case of using the LED unit 3 as an example of an image exposing member, other light emitting elements may be used, such as electro-luminescence (EL) elements, for example. EL is a phenomenon where light is emitted when electric energy is applied to matter and electrons go from the ground state to an excited state, and thereafter return to the ground state.

The control board 50 and LED head 3*a* are electrically connected by a cable 51, as illustrated in FIGS. 1 and 8. The cable 51 is laid on the outer side of and below the extracting member 13 to which the process cartridges P are detachably mounted, turns back at a turnaround portion 51*a*, and is connected to the control board 50.

The developing unit 4 illustrated in FIGS. 1 and 8 supplies toner 7, serving as a developing agent, to the electrostatic latent image formed on the surface of the photosensitive drum 1, so that the electrostatic latent image is developed. The intermediate transfer belt 5 is rotationally tensioned facing the surface of the photosensitive drum 1 by a drive roller 5*a*, a secondary transfer opposing roller 5*b*, and a tension roller 5*c*. The primary transfer roller 12 serving as a primary transfer unit is provided on the inner peripheral face side of the intermediate transfer belt 5, opposing the surface of the photosensitive drum 1.

Toner images formed on the surface of each of the photosensitive drums 1 in the respective process cartridges are sequentially transferred onto the outer peripheral face of the intermediate transfer belt 5 rotating in the clockwise direction in FIG. 1, and thus are superimposed, by primary transfer bias voltage being applied to the primary transfer roller 12 serving as a primary transfer unit.

On the other hand, a recording medium S accommodated within a sheet cassette 17 is fed out by a sheet feed roller 18, and further are separated by cooperation of an unshown separating unit and fed one sheet at a time. The recording medium S then abuts against a nip portion of temporarily-stopped registration rollers 19. Skew is corrected by the stiffness strength of the recording medium S, and thereafter the recording medium S is conveyed to a secondary transfer nip portion formed between the intermediate transfer belt 5 and a secondary transfer roller 29 serving as a secondary transfer unit, at a predetermined timing.

The toner image that has been transferred onto the outer peripheral face of the intermediate transfer belt 5 by primary transfer is then subjected to secondary transfer onto the surface of the recording medium S being pinched and conveyed by the intermediate transfer belt 5 and secondary transfer roller 29. This transfer is performed by secondary transfer bias voltage being applied to the secondary transfer roller 29 at the secondary transfer nip portion. Specific examples of the recording medium S include paper, overhead transparency (OHT) sheets used with overhead projectors (OHP), cloth, and so forth.

The image forming apparatus 100 further is provided with a cleaning device 6, serving as a cleaning unit that cleans toner 7 left remaining on the surface of the photosensitive drum 1 after having transferred the toner image.

The photosensitive drum 1 is formed by an organic photoconductive (OPC) layer of an organic photoconductor coated on the outer peripheral face of an aluminum cylinder, for example. The photosensitive drum 1 has both ends thereof in the axial direction rotate supported by a bearing member omitted from illustration. A coupled member 47 illustrated in FIG. 7, that receives rotational driving force from an unshown motor serving as a drive source is provided at one end of the photosensitive drum 1 in the axial direction. Thus, the photosensitive drum 1 rotates in the clockwise direction in FIG. 1, having been transmitted the driving force of the motor via the coupled member 47.

The charging roller 2 according to the present embodiment is of a contact charging type. More specifically, the charging roller 2 is made up of an electroconductive material formed into a roller shape. The charging roller 2 comes into contact with the surface of the photosensitive drum 1. Charging bias voltage is applied to the charging roller 2 from a charging bias power source omitted from illustration, thereby uniformly charging the surface of the photosensitive drum 1.

Cartridge

Figure 9:
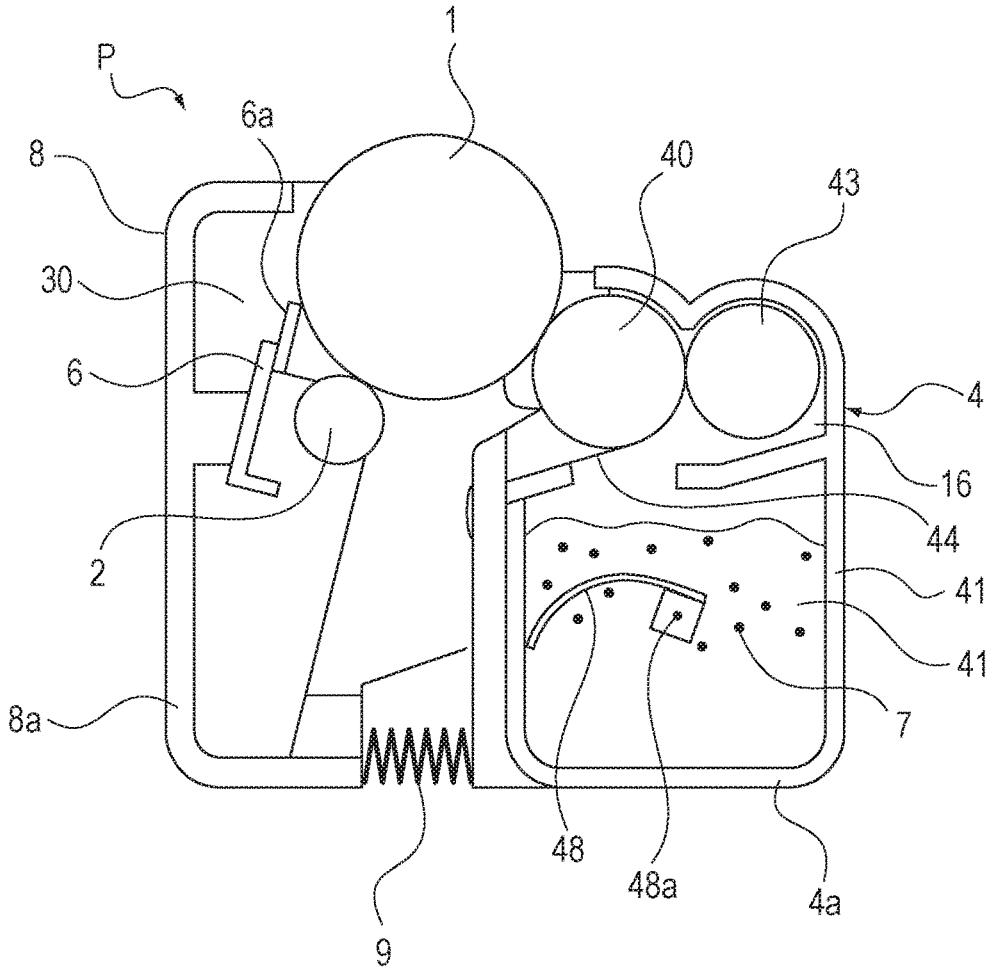
FIG. 9 is a cross-sectional explanatory diagram illustrating the configuration of a cartridge.

FIG. 9 is a cross-sectional explanatory diagram illustrating the configuration of the process cartridge P according to the present embodiment. The developing unit 4 illustrated in FIG. 9 has a toner container 41 serving as a developing agent container that accommodates the toner 7 serving as the developing agent. Toner 7 of the colors yellow (Y), magenta (M), cyan (C), and black (K), is accommodated in the toner containers 41 of the respective developing units 4.

A rotatable conveyance member 48 is provided to each toner container 41. The conveyance member 48 stirs the toner 7 accommodated within the toner container 41, and also conveys the toner 7 toward a supply roller 43 provided at the upper portion of the toner container 41. The supply roller 43 supplies the toner 7 to a developing roller 40 serving as a developing agent bearing member, disposed facing the surface of the photosensitive drum 1.

The toner 7 within the toner container 41 is conveyed by the conveyance member 48 and fed to the supply roller 43. The toner 7 is applied onto the outer peripheral face of the developing roller 40 by the supply roller 43 and a developing blade 44 in pressure contact with the outer peripheral face of the developing roller 40. Further, the toner 7 is charged with a charge. Applying a developing bias voltage to the developing roller 40 from a developing bias power source omitted from illustration causes the toner 7 to adhere to the electrostatic latent image formed on the surface of the photosensitive drum 1, thereby forming a toner image.

The developing roller 40 is disposed so as to oppose and come into contact with the photosensitive drum 1. The developing unit 4 provided with the toner container 41 accommodating the toner 7, and a photosensitive member unit 8 that rotatably supports the photosensitive drum 1 are provided so as to pivot on a hole 8*b* (see FIG. 7), thereby integrally making up the process cartridge P. The developing unit 4 and the photosensitive member unit 8 are urged by a biasing member 9 made up of a coil spring, whereby the developing roller 40 and the photosensitive drum 1 are in pressure contact. The entire process cartridge P can be removed from the image forming apparatus 100 main unit by the user and replaced, when the toner 7 within the toner container 41 has been consumed and the lifetime of the process cartridge P has been spent.

Image Forming Operation

Next, the image forming operation of forming a full-color image on the recording medium S by the image forming apparatus 100 will be described by way of FIGS. 1 and 9. In FIG. 1, the device information photosensitive drum 1 of each process cartridge P is rotationally driven at a predetermined circumferential velocity in the counterclockwise direction in FIG. 1. The charging roller 2 rotates following the photosensitive drum 1.

The intermediate transfer belt 5 also rotationally driven at a circumferential velocity corresponding to the circumferential velocity of the photosensitive drum 1, in the clockwise direction in FIG. 1 which is the forward direction as to the rotational direction of the photosensitive drum 1. The intermediate transfer belt 5 is configured as a dielectric endless belt that has flexibility. The intermediate transfer belt 5 is tensioned by the drive roller 5*a* that rotates under transmission of rotational driving force from the unshown motor serving as a drive source, the secondary transfer opposing roller 5*b*, and the tension roller 5*c*.

The endless belt forming the intermediate transfer belt 5 is tensioned in the same direction as the movement direction of the extracting member 13 illustrated in FIG. 2 (the horizontal direction in FIG. 2). The width of the intermediate transfer belt 5 in the axial direction is set corresponding to the width of the photosensitive drum 1 in the axial direction (longitudinal direction).

The developing roller 40 and supply roller 43 illustrated in FIG. 9 are each rotationally driven at a predetermined circumferential velocity. In each process cartridge P, predetermined charging bias voltage is applied to the charging roller 2 illustrated in FIG. 1 from the unshown charging bias power source, each at a predetermined timing, synchronously with this driving.

Thus, the surfaces of the photosensitive drums 1 are uniformly charged to a predetermined polarity and potential by the charging rollers 2. The LED units 3 expose the surface of the respective photosensitive drums 1 of the process cartridges P by information light corresponding to image signals of the colors yellow (Y), magenta (M), cyan (C), and black (K). Accordingly, electrostatic latent images are formed on the surfaces of the photosensitive drums 1 of the respective process cartridges P, in accordance with the image signals of the respective colors.

Predetermined developing bias voltage from the unshown developing bias power source is applied at a predetermined timing to the developing rollers 40 in each process cartridge P. Thus, the toner 7 of each color borne on the surfaces of the developing rollers 40 is supplied to the electrostatic latent images formed on the surface of each photosensitive drum 1, and thereby developed as respective toner images. For example, a toner image of the yellow (Y) color, corresponding to the yellow (Y) color component of the full-color image, is formed on the photosensitive drum 1 of the process cartridge PY by the above-described electrophotographic image forming process.

The primary transfer roller 12 is in pressure contact with the surface of the photosensitive drum 1 across the intermediate transfer belt 5, as illustrated in FIG. 1. This forms a primary transfer nip portion. Primary transfer bias voltage is applied from an unshown primary transfer bias power source to the primary transfer roller 12 in FIG. 1. Thus, the toner image formed on the surface of the photosensitive drum 1 is transferred by primary transfer onto the outer peripheral face of the intermediate transfer belt 5, at the primary transfer nip portion that is the contact portion between the surface of the photosensitive drum 1 and the outer peripheral surface of the intermediate transfer belt 5.

At the process cartridge PM, the magenta (M) color toner image formed on the surface of the photosensitive drum 1 is similarly transferred by primary transfer onto the outer peripheral face of the intermediate transfer belt 5, so as to be superimposed on the yellow (Y) color toner image. At the process cartridge PC, the cyan (C) color toner image formed on the surface of the photosensitive drum 1 is similarly transferred by primary transfer onto the outer peripheral face of the intermediate transfer belt 5 so as to be further superimposed. At the process cartridge PK, the black (K) color toner image formed on the surface of the photosensitive drum 1 is similarly transferred by primary transfer onto the outer peripheral face of the intermediate transfer belt 5 so as to be further superimposed.

This yields a composited formation of superimposed unfixed toner images of a full-color image of the four colors of yellow (Y), magenta (M), cyan (C), and black (K), on the outer peripheral surface of the intermediate transfer belt 5. Note that the order of the colors of superimposing the toner images transferred onto the outer peripheral surface of the intermediate transfer belt 5 is not restricted to the above-described order, and that any suitable order of superimposing may be used.

After primary transfer of the toner images formed on the surfaces of the photosensitive drums 1 into the outer peripheral surface of the intermediate transfer belt 5 at each process cartridge P, untransferred residual toner remaining on the photosensitive drums 1 is scraped off and removed by a cleaning blade 6*a* provided to the cleaning device 6 illustrated in FIG. 9. The removed residual toner is then recovered and accommodated in a residual toner container 30.

On the other hand, the sheet feed roller 18 illustrated in FIG. 1 is rotationally driven at a predetermined timing. Accordingly, sheets of the recording medium S stacked in the sheet cassette 17 are fed out. A recording medium S is guided by the registration rollers 19 into the secondary transfer nip portion, which is the contact portion of the outer peripheral surface of the intermediate transfer belt 5 and the secondary transfer roller 29, at a predetermined timing.

A secondary transfer bias of a predetermined potential and the opposite polarity to the charging polarity of the toner 7 is applied to the secondary transfer roller 29 at a predetermined timing. Thus, the superimposed toner image of the toner images of the four colors, on the outer peripheral surface of the intermediate transfer belt 5, is transferred all at once by secondary transfer onto the recording medium S, as the recording medium S is pinched and conveyed through the secondary transfer nip portion.

The recording medium S that has passed through the secondary transfer nip portion is separated from the outer peripheral surface of the intermediate transfer belt 5 and guided to a fixing device 20 serving as a fixing unit. The toner image is then thermally fixed on the recording medium S by heating and pressuring at a fixing nip portion by a fixing roller and pressing roller provided to the fixing device 20.

Thus, the toner images of each color are mixed and thermally fixed to the recording medium S. The recording medium S on which the full-color toner image has been thermally fixed is then discharged from the fixing device 20, pinched and conveyed by discharge rollers 23, and discharged onto a discharge tray 24.

The secondary transfer roller 29 according to the present embodiment is movable by a moving unit, omitted from illustration, between a first position of coming into contact with the outer peripheral surface of the intermediate transfer belt 5 and forming the secondary transfer nip portion, and a retreated second position of departing from the outer peripheral surface of the intermediate transfer belt 5. At the time of the image forming apparatus 100 forming images, the secondary transfer roller 29 is moved to the first position, and when not forming images, to the second position. Note that a configuration may be made where the secondary transfer roller 29 is left in contact with the outer peripheral surface of the intermediate transfer belt 5 at all times.

In the present embodiment, a configuration is employed where the intermediate transfer belt 5 is disposed above the photosensitive drum 1, and the LED unit 3 is disposed beneath the photosensitive drum 1. The unfixed toner images of yellow (Y), magenta (M), cyan (C), and black (K), are formed superimposed on the outer peripheral surface of the intermediate transfer belt 5. The full-color toner image formed by superimposing the toner images on the outer peripheral surface of the intermediate transfer belt 5 can then be promptly transferred into the recording medium S by way of the secondary transfer roller 29. This is advantageous in that the time period until the first printed article is output is short.

Supporting Member

Of the various members (parts) making up the image forming apparatus 100 according to the present embodiment, those excluding at least the extracting member 13 serving as the supporting member and members (parts) configured to be fixed or detachably mounted to the extracting member 13 will be referred to as "image forming apparatus 100 main unit".

The configuration of the extracting member 13 serving as the supporting member will be described with reference to FIGS. 1 and 2. The process cartridges P are mounted in and supported by respective mounting portions 13*f* of the extracting member 13 serving as the supporting member. The extracting member 13 is configured to be movable in this state between an inside position situated inside the image forming apparatus 100 main unit (the main unit of the image forming apparatus) and an outside position situated outside of the image forming apparatus 100 main unit.

The extracting member 13 is provided so as to be linearly movable (by pressing in and pulling out) in the direction of arrows D1 and D2 in FIG. 2, as to the image forming apparatus 100 main unit, as illustrated in FIG. 2. The extracting member 13 can be moved to the inside position of being situated inside the image forming apparatus 100 main unit as illustrated in FIG. 1, and the outside position having been pulled out to the outside of the image forming apparatus 100 main unit.

Figure 13A:
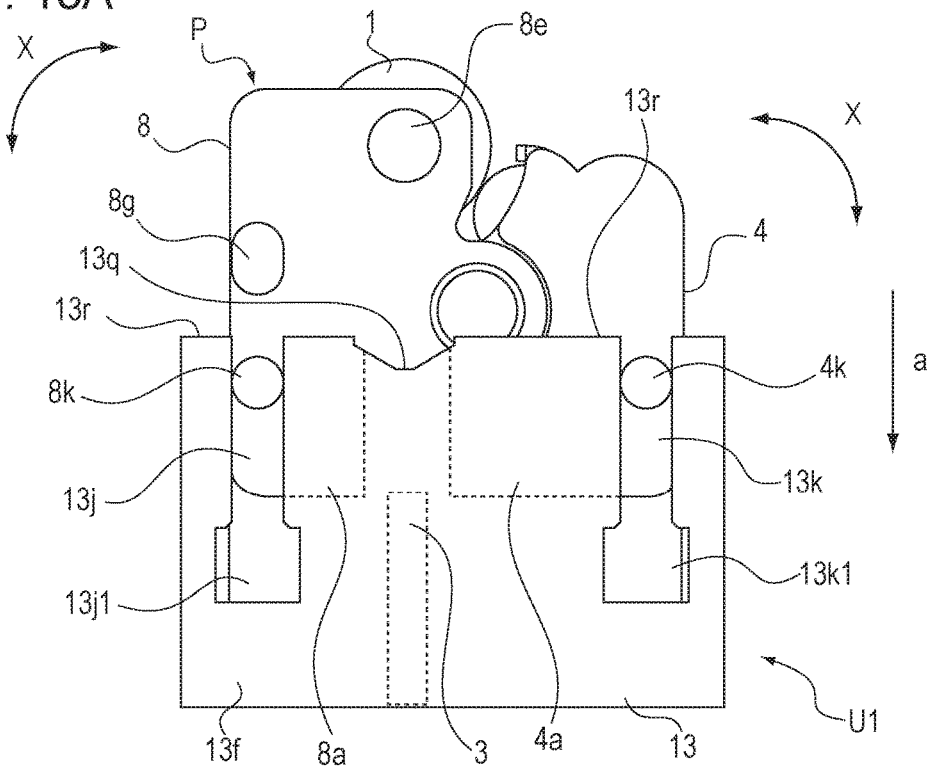
FIG. 13A is a cross-sectional explanatory diagram illustrating a cartridge being mounted to the mounting portion of the supporting member.
Figure 13B:
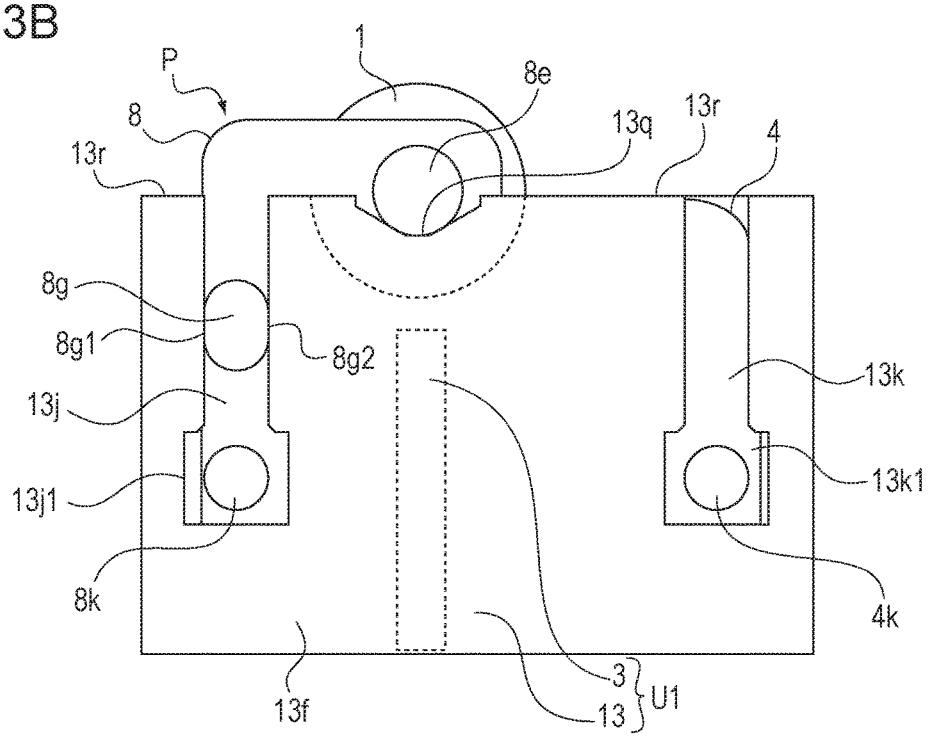
FIG. 13B is a cross-sectional explanatory diagram illustrating mounting of the cartridge to the mounting portion of the supporting member having been completed.

In a state where the extracting member 13 is situated at a position outside of the image forming apparatus 100 main unit as illustrated in FIG. 2, each process cartridge P is mounted to its mounting portion 13*f* provided to the extracting member 13, in a mounting direction that is the direction indicated by arrow a in FIG. 2 (substantially the gravitational direction). The extracting member 13 is configured such that the upstream side of the light emitting surface 3*a*1 is opened, when mounting a process cartridge P to a mounting portion 13*f* in the direction a. The vertical direction component vector of the vector L1 of the normal direction of the light emitting surface 3*a*1 is the opposite direction to the vertical direction component vector of the mounting direction a. FIGS. 13A and 13B illustrate a process cartridge P being mounted to the correct mounting position in the mounting portion 13*f*. The mounting direction indicated by arrow a in FIG. 2 in which the process cartridges P are mounted to the mounting portions 13*f* of the extracting member 13 is a direction orthogonal to the axial direction of the photosensitive drums 1 provided in the process cartridges P.

The process cartridges P mounted to the mounting portions 13*f* of the extracting member 13 are disposed so that the longitudinal direction thereof (axial direction of the photosensitive drums 1) is orthogonal to the direction of movement of the extracting member 13 (direction of arrows D1 and D2 in FIG. 2). The four process cartridges PY, PM, PC, and PK are arrayed in the direction of movement of the extracting member 13 (the left-right direction in FIGS. 1 and 2.

The process cartridges P are moved to the inside position of the image forming apparatus 100 main unit along with the extracting member 13, in a state of being mounted to the mounting portions 13*f* of the extracting member 13. The extracting member 13 is thus moved into the image forming apparatus 100 main unit as illustrated in FIG. 1. A door 10 that pivots on a pivot axis, omitted from illustration, is closed as to the image forming apparatus 100 main unit in this state. All process cartridges P are thus positioned to their predetermined positions within the image forming apparatus 100 main unit.

In this way, the image forming apparatus 100 according to the present embodiment enables the four process cartridges P to be mounted into the image forming apparatus 100 main unit at once by the extracting member 13. The four process cartridges P can also be extracted to the outside of the image forming apparatus 100 main unit at once. Accordingly, this configuration is advantageous over a configuration where the process cartridges P are individually mounted into the image forming apparatus 100 main unit, from the perspective of ease of work when replacing the process cartridges P.

Mounting Portion for Supporting Member

Figure 3:
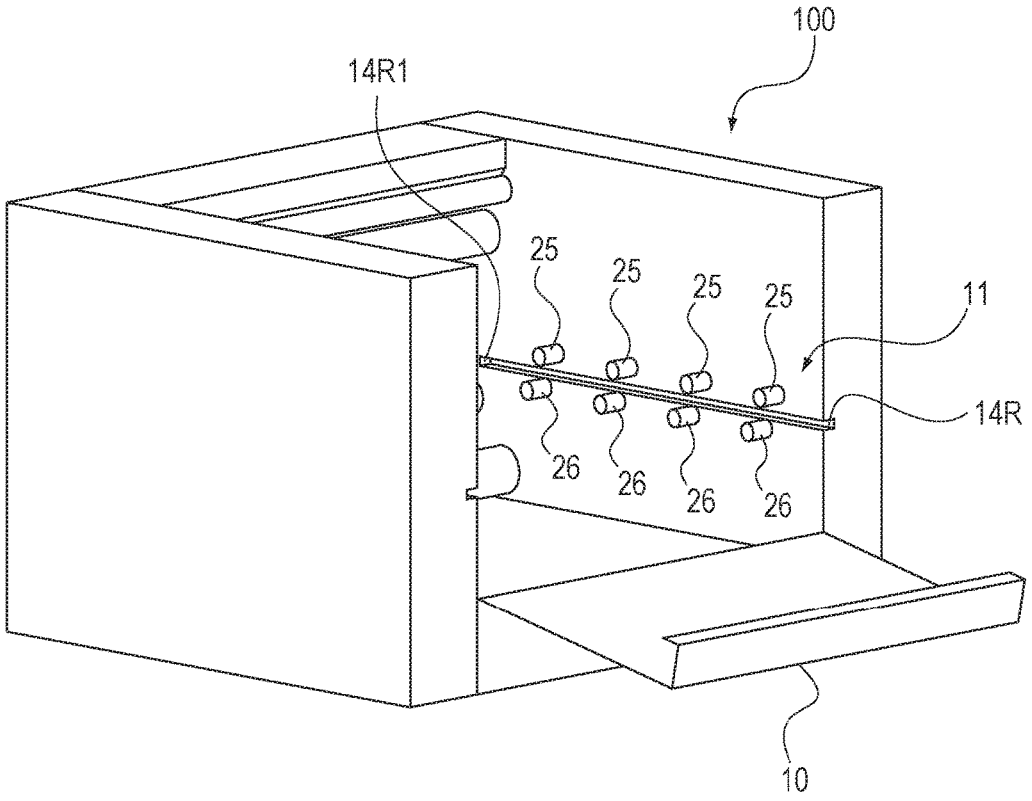
FIG. 3 is a perspective explanatory diagram illustrating the configuration of a mounting portion for mounting the supporting member of the main unit of the image forming apparatus.
Figure 4:
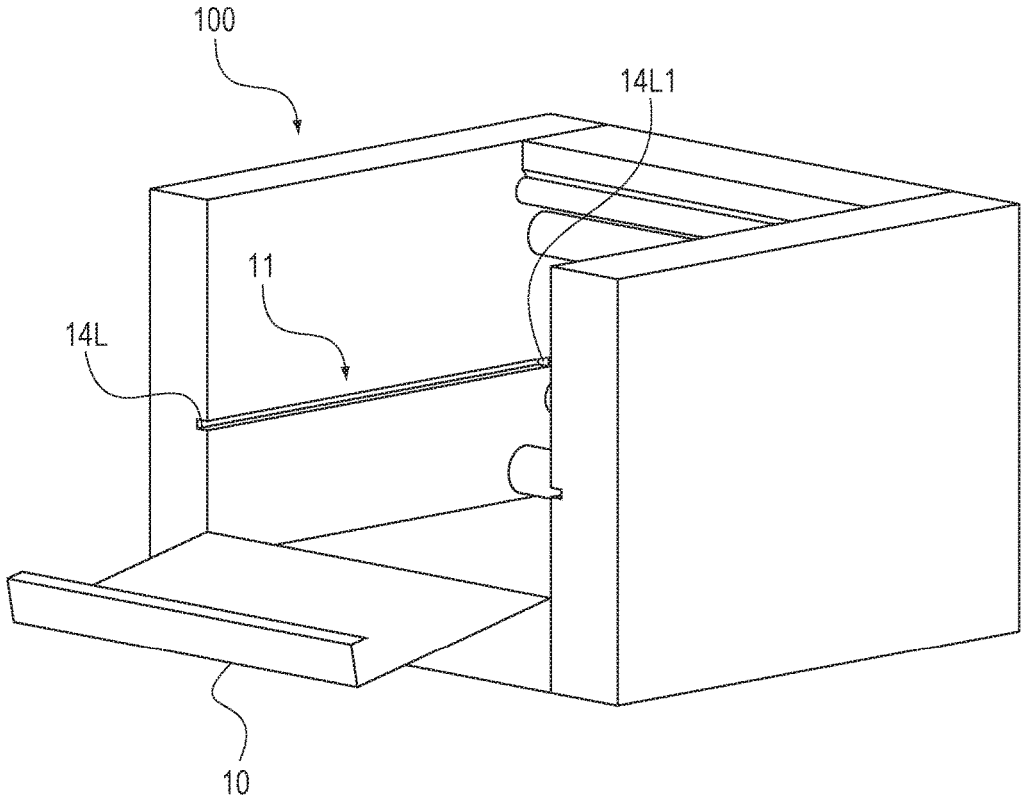
FIG. 4 is a perspective explanatory diagram illustrating the configuration of the mounting portion for mounting the supporting member of the main unit of the image forming apparatus.

The configuration of a mounting portion 11 for the extracting member 13, that is provided in the image forming apparatus 100 main unit, will be described with reference to FIGS. 3 and 4. FIGS. 3 and 4 are perspective explanatory diagrams illustrating the configuration of the mounting portion 11 for the extracting member 13 that is provided in the image forming apparatus 100 main unit according to the present embodiment.

Some of the members (parts) making up the image forming apparatus 100 main unit, such as the intermediate transfer belt 5 and so forth, have been omitted from illustration in FIGS. 3 and 4, so that the configuration of the mounting portion 11 provided in the image forming apparatus 100 main unit can be more readily understood. FIGS. 3 and 4 are perspective explanatory diagrams illustrating the image forming apparatus 100 main unit from different directions.

A pair of guide portions 14R and 14L, serving as regulating portions to guide the movement direction of the extracting member 13, are provided on the inner wall faces of an apparatus frame of the image forming apparatus 100 main unit so as to face one another, as illustrated in FIGS. 3 and 4. These guide portions 14R and 14L slidably support guided portions 13*a* through 13*d* of the extracting member 13, illustrated in FIGS. 5 and 6. The guide portions 14R and 14L are formed having shapes of boxes with one side open, as illustrated in FIGS. 3 and 4.

Figure 5:
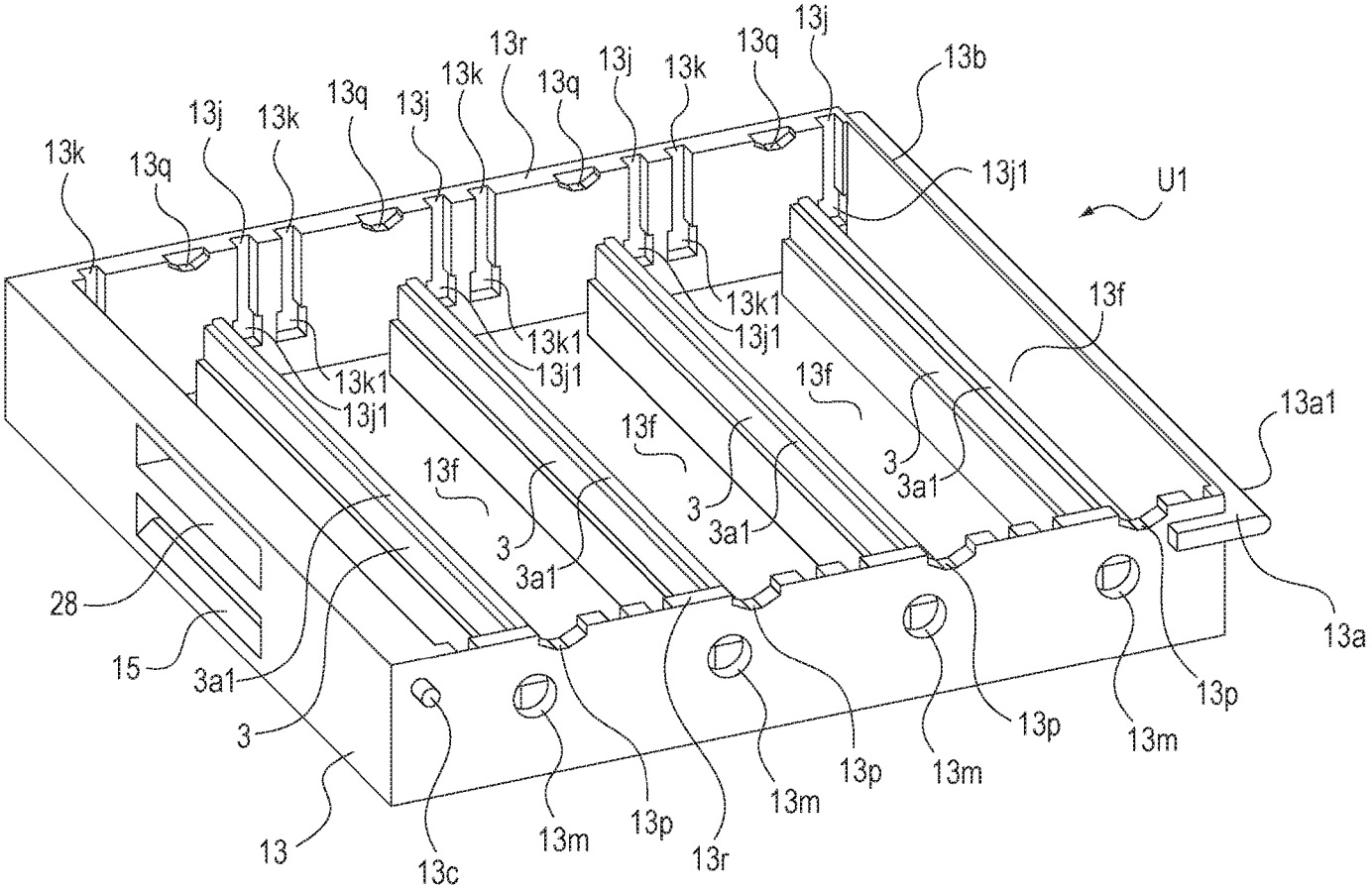
FIG. 5 is a perspective explanatory diagram illustrating the configuration of the supporting member of the image forming apparatus.
Figure 6:
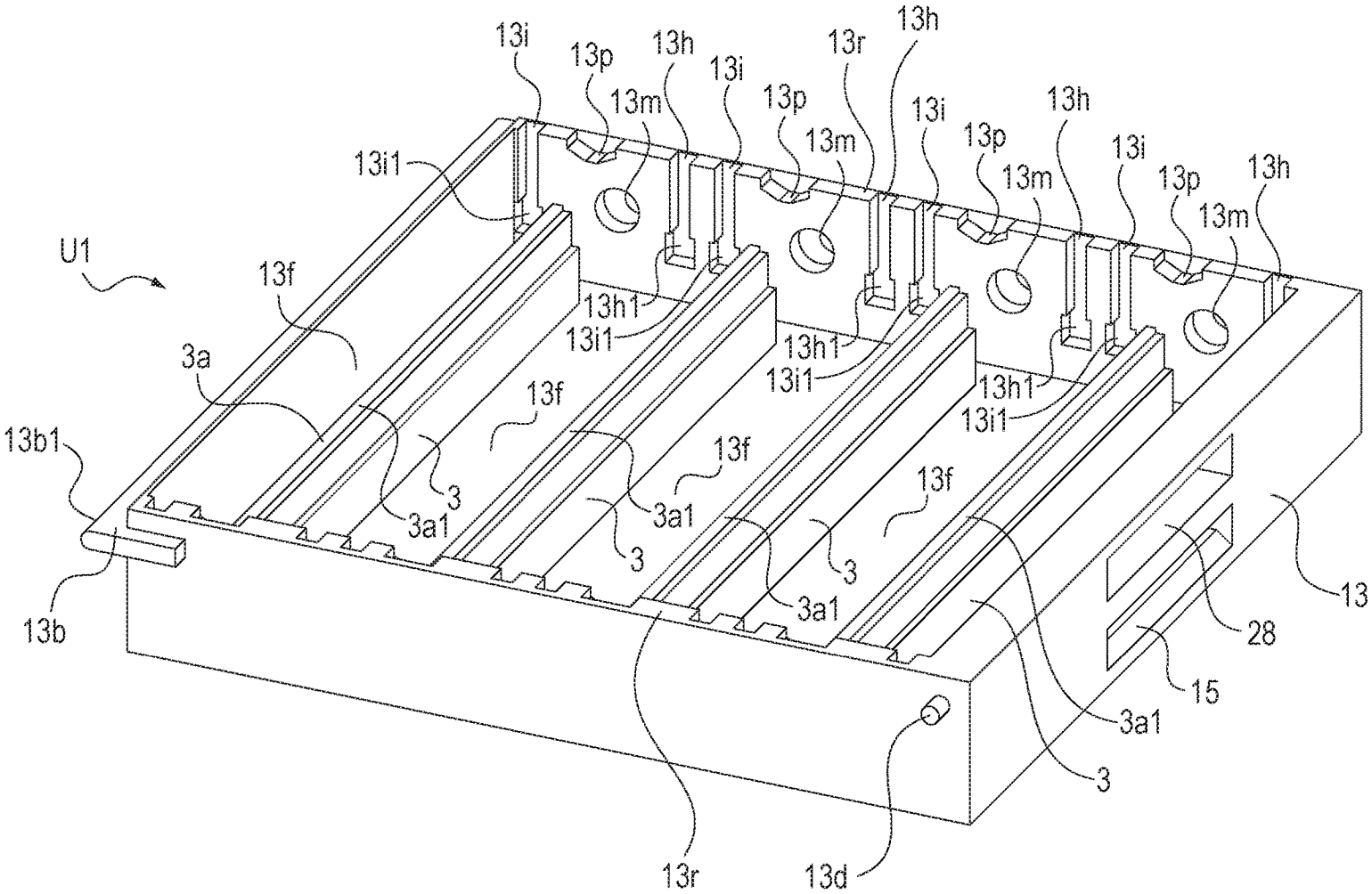
FIG. 6 is a perspective explanatory diagram illustrating the configuration of the supporting member.

The guide portions 14R and 14L illustrated in FIGS. 3 and 4 can guide the extracting member 13 from a position where the extracting member 13 is extracted to the outside of the image forming apparatus 100 main unit to a position where the extracting member 13 is stored inside the image forming apparatus 100 main unit, illustrated in FIGS. 5 and 6. The guide portions 14R and 14L extend generally horizontally from near the entrance of the image forming apparatus 100 main unit (near the door 10) to the deep end thereof.

Drum coupling members 25 are rotatably supported above the guide portion 14R to transmit rotational driving force to each of the photosensitive drums 1, as illustrated in FIG. 3. On the other hand, developing coupling members 26 are rotatably supported below the guide portion 14R to transmit rotational driving force to each of the developing rollers 40. The drum coupling members 25 and developing coupling members 26 are each disposed equidistantly in the horizontal direction along the guide portion 14R.

The drum coupling members 25 and developing coupling members 26 illustrated in FIG. 3 transmit rotational driving force from a drive source provided within the image forming apparatus 100 main unit but omitted from illustration, to the photosensitive drums 1 and developing rollers 40 of the process cartridges P. In a state where the door 10 is open, the drum coupling members 25 and developing coupling members 26 are retracted to inside the side wall of the image forming apparatus 100 main unit. Synchronously with the action of closing the door 10, the drum coupling members 25 and developing coupling members 26 protrude from the inner wall face of the image forming apparatus 100 main unit toward the process cartridges P.

Figure 7:
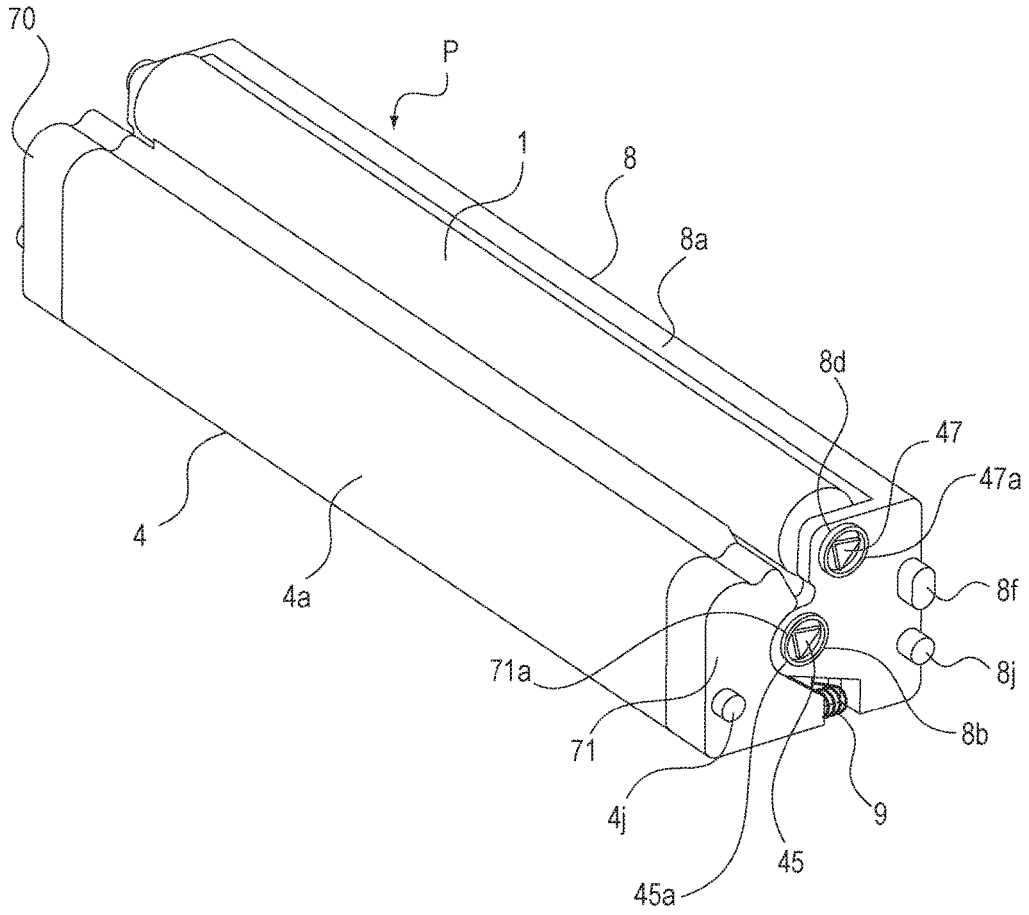
FIG. 7 is a perspective explanatory diagram illustrating the configuration of a cartridge from the drive side.

The coupled members 47 and 45 illustrated in FIG. 7 are provided on the rotation shafts of each of the photosensitive drums 1 and developing rollers 40.

Rotational driving force from the motor, serving as a drive source, provided to the image forming apparatus 100 main unit but is omitted from illustration, is transmitted to the drum coupling members 25 and developing coupling members 26. The drum coupling members 25 and developing coupling members 26 illustrated in FIG. 3 engage the coupled members 47 and 45 illustrated in FIG. 7. Accordingly, the rotational driving force from the motor, serving as a drive source, provided to the image forming apparatus 100 main unit but omitted from illustration, is transmitted to each of the photosensitive drums 1 and developing rollers 40 of the process cartridges P.

Next, the configuration of the extracting member 13 will be described in further detail with reference to FIGS. 5 and 6. FIG. 5 is a perspective explanatory diagram illustrating the configuration of the extracting member 13 of the image forming apparatus 100 according to the present embodiment. FIG. 6 is a perspective explanatory diagram viewing the extracting member 13 in FIG. 5 from the opposite side.

The guided portions 13*a* through 13*d* are provided protruding on the four corners of the extracting member 13, so as to be able to slidably engage the guide portions 14R and 14L provided on the inner side walls of the image forming apparatus 100 main unit as illustrated in FIGS. 3 and 4. The guided portions 13*a* and 13*c* illustrated in FIG. 5 are slidably engaged with and guided by the guide portion 14R illustrated in FIG. 3, and the guided portions 13*b* and 13*d* illustrated in FIG. 6 are slidably engaged with and guided by the guide portion 14L illustrated in FIG. 4.

Figure 12:
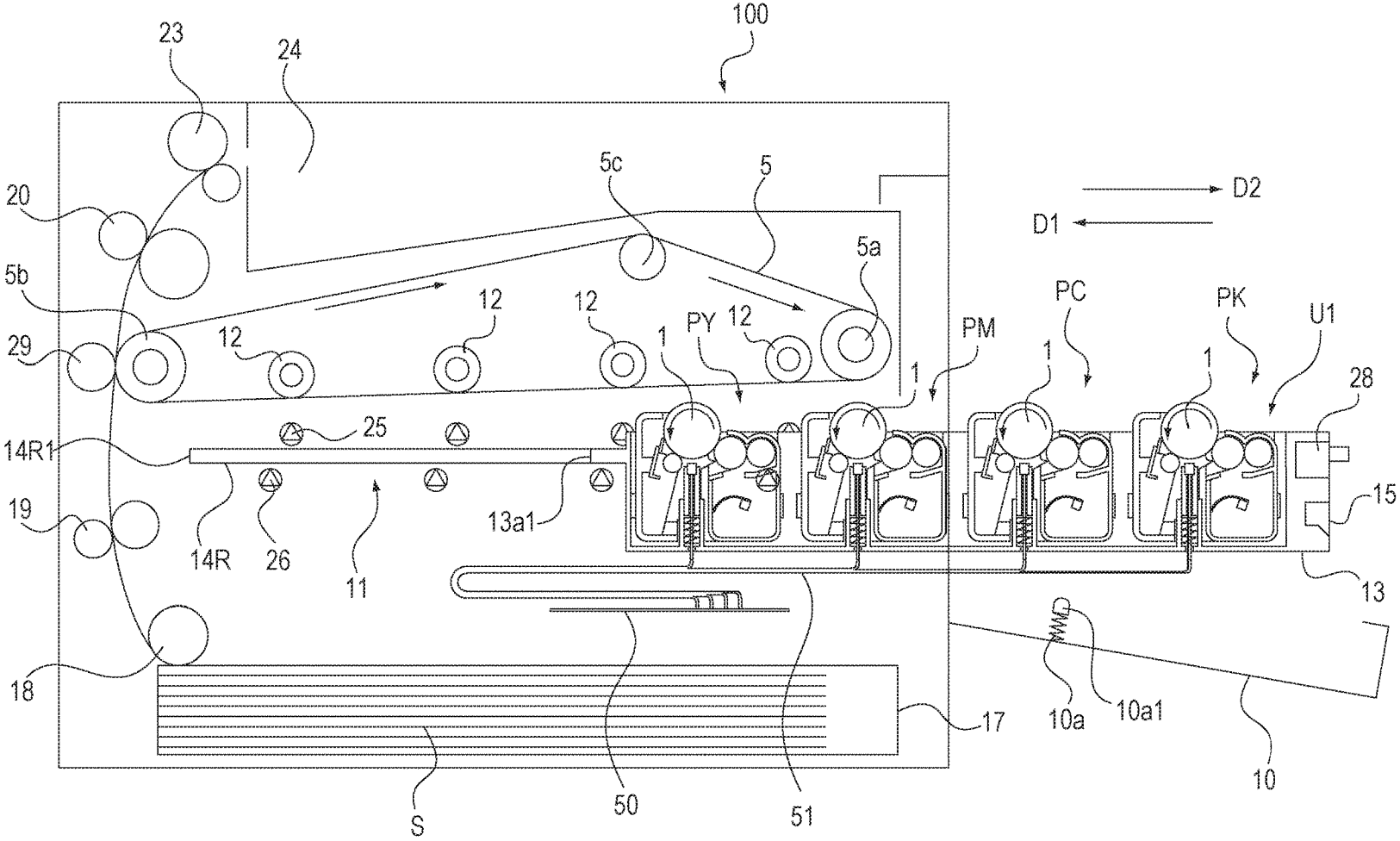
FIG. 12 is a cross-sectional explanatory diagram illustrating the supporting member being mounted into the main unit of the image forming apparatus.

The guided portions 13*a* and 13*b* illustrated in FIGS. 5 and 6 are formed having shapes of boxes with one side open, each protruding outwards from the side faces of the extracting member 13. The guided portions 13*a* and 13*b* are configured extending in the extracting direction (left-right direction in FIG. 12), so that the extracting member 13 does not tilt at the position where the extracting member 13 has been pulled out of the image forming apparatus 100 main unit, as illustrated in FIG. 12. On the other hand, the guided portions 13*c* and 13*d* illustrated in FIGS. 5 and 6 are configured as posts protruding outwards from the side faces of the extracting member 13.

A handle 28 for the user to operate the extracting member 13 is provided to the edge face at the downstream side in the extracting direction of the extracting member 13 (to the right side in FIG. 12), as illustrated in FIGS. 5 and 6. Provided below the handle 28 is a recess 15. A pressing member 10*a* made up of a coil spring has one end thereof retained at the door 10 as illustrated in FIG. 12. An abutting portion 10*a*1 which is provided to the other end of the pressing member 10*a* is inserted into and abuts the recess 15.

The door 10 is closed in a state where the extracting member 13 is inserted to a predetermined position within the image forming apparatus 100 main unit, as illustrated in FIG. 1. This causes the abutting portion 10*a*1, provided on the other end of the pressing member 10*a* of which one end is retained on the inner face of the door 10, to be inserted into the recess 15 of the extracting member 13 and abut against the wall face of the recess 15. The urging force of this pressing member 10*a* urges the extracting member 13 in the left direction in FIG. 1. Thus, the extracting member 13 can be positioned within the image forming apparatus 100 main unit.

The extracting member 13 has a row of mounting portions 13*f* arrayed, for mounting the process cartridges P of each color, as illustrated in FIGS. 5 and 6. The LED unit 3 is erected in each mounting portion 13*f* of the extracting member 13, as illustrated in FIG. 8. In the present embodiment, the extracting member 13 and the LED unit 3 make up an extracting unit U1.

An LED head 3*a* provided to the leading edge of the LED unit 3 is fixedly supported by a supporting member 3*b*, as illustrated in FIG. 8. The supporting member 3*b* is supported by a holder member 13*s* provided to the extracting member 13, so as to be movable in the vertical direction in FIG. 8 along the inside of the holder member 13*s*.

Figure 10:
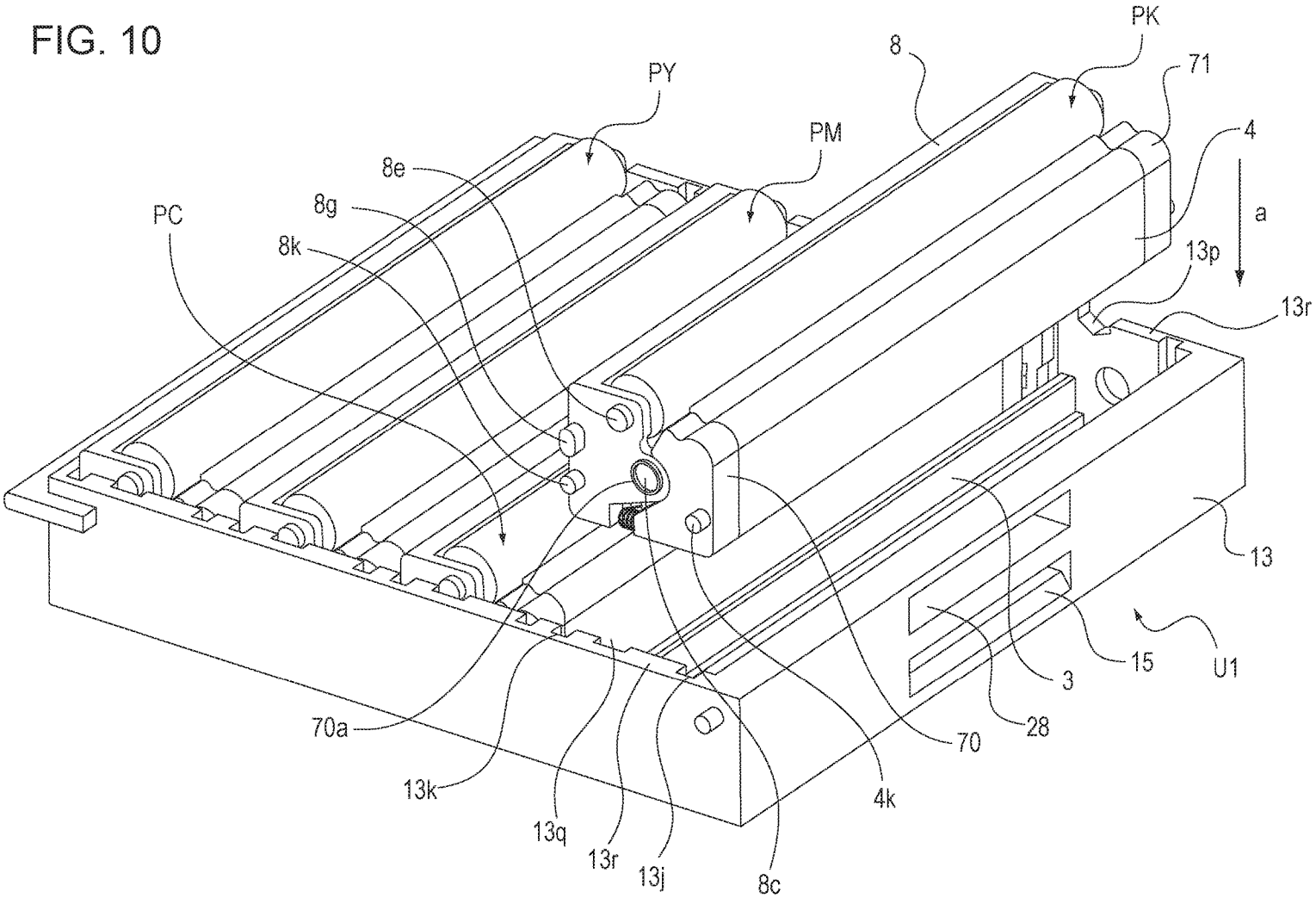
FIG. 10 is a perspective explanatory diagram illustrating mounting cartridges to a mounting portion of the supporting member, as viewed from the non-drive side.

At both end portions in the longitudinal direction of the process cartridges P of each color, regulated portions 4*j*, 4*k*, 8*j*, and 8*k*, which are each formed as posts, are provided protruding at a first frame 8*a* of the photosensitive member unit 8 and a second frame 4*a* of the developing unit 4, as illustrated in FIGS. 7 and 10.

At one end and the other end of each mounting portion 13*f* in the longitudinal direction are provided guide portions 13*h*, 13*i*, 13*j*, and 13*k*, formed as grooves to serve as rotation regulating portions, as illustrated in FIGS. 5 and 6. The guide portions 13*h* through 13*k* come into contact with the regulated portions 4*j*, 4*k*, 8*j*, and 8*k* illustrated in FIGS. 7 and 10, and position the rotational posture of the process cartridge P of each color in the circumferential direction (the direction indicated by the arrow X in FIG. 13A)). The guide portions 13*h* through 13*k* formed as grooves along the direction of mounting the process cartridge P, indicated by arrow a in FIG. 2, are provided to the mounting portion 13*f*. The width of the grooves of the guide portions 13*h* through 13*k* correspond to the outer diameters of the regulated portions 4*j*, 4*k*, 8*j*, and 8*k*.

The guide portions 13*h* through 13*k* extend in the vertical direction of the extracting member 13. The post-shaped regulated portions 4*j*, 4*k*, 8*j*, and 8*k* formed on the process cartridges P are inserted into the guide portions 13*h* through 13*k* provided to each mounting portion 13*f* of the extracting member 13. Thus, the process cartridges P of each color can be mounted and positioned within their respective mounting portions 13*f*.

Positioning portions 13*p* and 13*q* are provided between the guide portions 13*h* and 13*i* illustrated in FIG. 6, and between the guide portions 13*j* and 13*k* illustrated in FIG. 5. The positioning portions 13*p* and 13*q* are grooves for positioning the process cartridges P as to the mounting portions 13*f*, and a formed having V-shaped slopes.

The extracting member 13 is provided with openings 13*m* that are through holes as illustrated in FIG. 5, into which the developing coupling members 26 protruding from the inner side walls of the image forming apparatus 100 main unit illustrated in FIG. 3 enter. The developing coupling members 26 enter the openings 13*m* formed in the extracting member 13 synchronously with the action of the door 10 being closed as to the image forming apparatus 100 main unit.

Cartridge

Next, the configuration of the process cartridge P mounted to the mounting portions 13*f* of the extracting member 13 will be described by way of FIGS. 7, 9, and 10. FIG. 7 is a perspective explanatory diagram illustrating the configuration of the process cartridge P according to the present embodiment. FIG. 9 is a cross-sectional explanatory diagram illustrating the configuration of the process cartridge P according to the present embodiment. FIG. 10 is a perspective explanatory diagram illustrating the process cartridge P according to the present embodiment being mounted to the mounting portion 13*f* of the extracting member 13.

The process cartridge P has the photosensitive member unit 8 and developing unit 4, as illustrated in FIGS. 7 and 9. The photosensitive member unit 8 is configured including the photosensitive drum 1 serving as the image bearing member, the first frame 8*a* supporting the photosensitive drum 1, the charging roller 2 serving as a charging unit, and the cleaning device 6 serving as a cleaning unit, as illustrated in FIG. 9. The cleaning blade 6*a* provided to the cleaning device 6 scrapes off and removes toner 7 remaining on the surface of the photosensitive drum 1 after primary transfer. The toner removed by the cleaning blade 6*a* is collected within the residual toner container 30 and recovered.

On the other hand, the developing unit 4 has the developing roller 40 serving as a developing agent bearing member, and the second frame 4*a* rotate supporting the developing roller 40. Further, the toner container 41 serving as a developing agent container that accommodates the toner 7, is provided to a part of the second frame 4*a*. Moreover, the conveyance member 48 that stirs and conveys the toner 7 accommodated within the toner container 41 is provided to the developing unit 4. The conveyance member 48 conveys the toner 7 accommodated within the toner container 41 to a developing chamber 16, by rotating in the clockwise direction in FIG. 9 on a rotation axis 48*a*. The developing unit 4 is configured further including the supply roller 43 that supplies the toner 7 conveyed into the developing chamber 16 to the developing roller 40, and the developing blade 44 that restricts the thickness of the toner 7 borne on the surface of the developing roller 40.

The toner 7 within the toner container 41 is fed into the developing chamber 16 where the supply roller 43 is provided, by the conveyance member 48 that rotates in the clockwise direction in FIG. 9 on the rotation axis 48*a*. Toner 7 is coated on the outer peripheral surface of the developing roller 40 by the supply roller 43 and the developing blade 44 pressed against the perimeter of the developing roller 40, and the toner 7 is charged with a charge.

A developing bias voltage is applied from the developing bias power source provided to the image forming apparatus 100 main unit to the developing roller 40. Thus, toner 7 that had been borne on the outer peripheral surface of the developing roller 40 adheres to the electrostatic latent image formed on the surface of the photosensitive drum 1, thereby forming a toner image.

The toner image developed on the surface of the photosensitive drum 1 is subjected to primary transfer into the outer peripheral surface of the intermediate transfer belt 5 by the action of the primary transfer roller 12, and thereafter is further transferred onto the recording medium S by action of the secondary transfer roller 29. After the primary transfer, the toner 7 remaining on the surface of the photosensitive drum 1 is scraped off and removed by the cleaning blade 6*a* provided to the cleaning device 6, and is collected within the residual toner container 30 and recovered. In a case where the toner 7 within the toner container 41 has been consumed, the user can replace the process cartridge P and print again.

The coupled member 47 illustrated in FIG. 7 is rotationally supported at one end of the process cartridge P in the longitudinal direction, to engage the drum coupling member 25 provided at the image forming apparatus 100 main unit side as illustrated in FIG. 3, so as to receive the rotation driving force. The coupled member 45 also is rotationally supported, to engage the developing coupling member 26 provided at the image forming apparatus 100 main unit side as illustrated in FIG. 3, so as to receive the rotation driving force.

The coupled member 47 is provided at one end side of the photosensitive drum 1 in the longitudinal direction, as illustrated in FIG. 7. The rotational driving force from the unshown motor serving as a drive source, provided to the image forming apparatus 100 main unit, is transmitted to the drum coupling member 25, and the photosensitive drum 1 is rotated by the rotational driving force that the coupled member 47 engaged with the drum coupling member 25 has received.

In the same way, the rotational driving force from the unshown motor serving as a drive source, provided to the image forming apparatus 100 main unit, is transmitted to the developing coupling member 26. The rotational driving force that the coupled member 45 engaged with the developing coupling member 26 has received is transmitted to the developing roller 40, supply roller 43, and conveyance member 48, illustrated in FIG. 9, via an intermediate gear that is omitted from illustration. These members rotate integrally.

The outer perimeter of the coupled member 45 is covered by a cylinder rib 45*a*, forming an engaging portion 71*a*. The engaging portion 71*a* is provided to a side cover 71 fixed to the outside of the toner container 41. The coupled member 45 is configured to be rotatable as to the engaging portion 71*a*.

An engaging portion 70*a* is provided on the opposite side from the engaging portion 71*a*, in the longitudinal direction of the process cartridge P, as illustrated in FIG. 10. This engaging portion 70*a* is similarly provided to a side cover 70. The engaging portions 71*a* and 70*a* are both provided to the developing unit 4.

The first frame 8*a* also is provided with holes 8*b* and 8*c* which are through holes that support the engaging portions 71*a* and 70*a*. The holes 8*b* and 8*c* provided to the first frame 8*a* engage the engaging portions 71*a* and 70*a* provided to the developing unit 4. This enables the photosensitive member unit 8 and developing unit 4 to be rotate joined to each other. Thus, the first frame 8*a* of the photosensitive member unit 8 and the second frame 4*a* of the developing unit 4 are configured so as to be movable as to each other.

The engaging portions 71*a* and 70*a* are configured so as to be capable of pivoting as to the holes 8*b* and 8*c*. Accordingly, the developing unit 4 can move in relation to the photosensitive member unit 8. That is to say, the developing roller 40 is configured so as to be separable from and in pressure contact with the photosensitive drum 1.

The biasing member 9 made up of a coil spring is provided between the photosensitive member unit 8 and the developing unit 4, as illustrated in FIGS. 7 and 9. The urging force of the biasing member 9 presses the developing roller 40 against the photosensitive drum 1 with a predetermined pressure.

Figure 19:
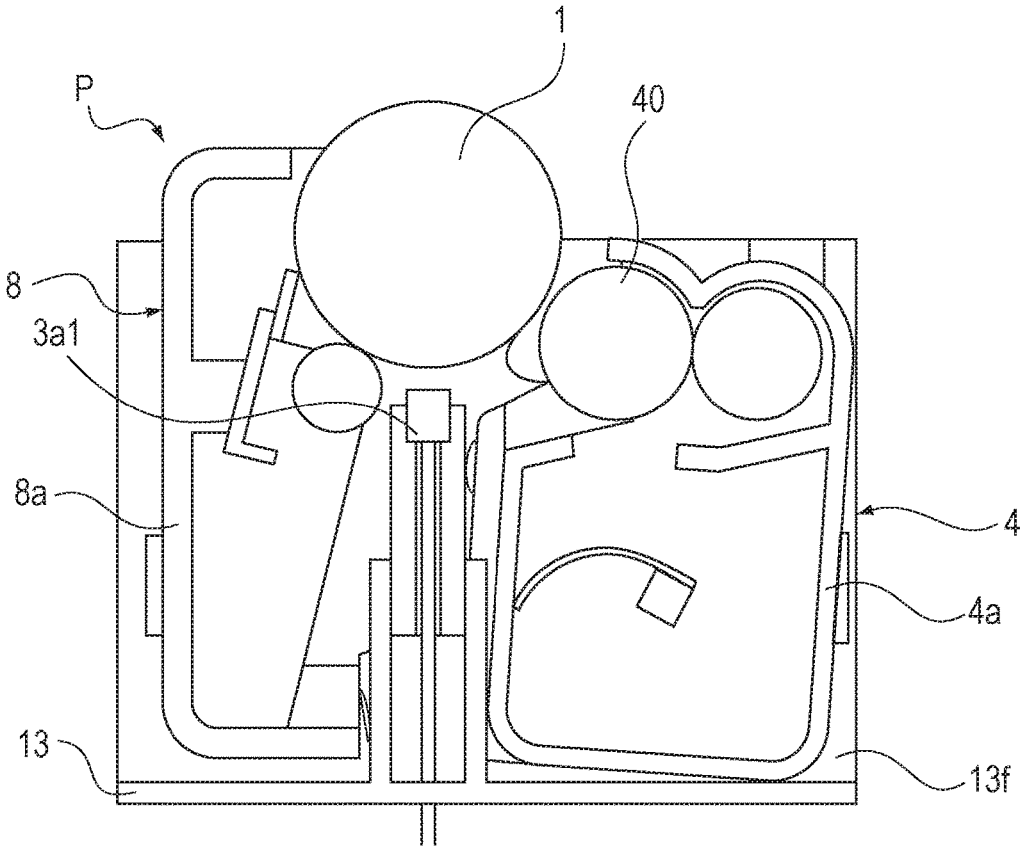
FIG. 19 is a cross-sectional explanatory diagram illustrating the cartridge having been mounted to the mounting portion of the supporting member.

A pressuring member that is omitted from illustration, that pressures the developing unit 4 against the urging force of the biasing member 9, is provided to the image forming apparatus 100 main unit so as to separate the developing roller 40 from the photosensitive drum 1. FIG. 19 illustrates a state where a process cartridge P has been positioned in the extracting member 13 and the extracting member 13 has been positioned in the image forming apparatus 100 main unit, in which the pressuring member presses the developing unit 4 and the developing roller 40 is separated from the photosensitive drum 1. When toner is not supplied to the electrostatic latent image formed on the surface of the photosensitive drum 1 (when not forming images), the developing roller 40 is separated from the photosensitive drum 1 in this way, thereby suppressing toner from unnecessarily adhering to the photosensitive drum 1.

The outer perimeter of the coupled member 47 is covered by the rib 47*a* as illustrated in FIG. 7, thereby forming a positioned portion 8*d*. A positioned portion 8*e* made up of a cylinder protrusion is provided on the opposite end from the positioned portion 8*d* in the longitudinal direction of the process cartridge P, as illustrated in FIG. 10.

As illustrated in FIG. 7, a rotation-regulated portion 8*f* is provided below the positioned portion 8*d*, and as illustrated in FIG. 10, a rotation-regulated portion 8*g* is provided below the positioned portion 8*e*. The rotation-regulated portions 8*f* and 8*g* have generally rectangular post shapes extending in the same direction as the direction of mounting the process cartridge P as to the extracting member 13.

The positioned portions 8*d* and 8*e*, and the rotation-regulated portion 8*f* and 8*g*, function to position the process cartridge P within the mounting portion 13*f* of the extracting member 13, as illustrated in FIGS. 7 and 10. The cylindrical regulated portions 4*j*, 4*k*, 8*j*, and 8*k* are provided below the rotation-regulated portions 8*f* and 8*g* illustrated in FIGS. 7 and 10. The regulated portions 4*j*, 4*k*, 8*j*, and 8*k* are provided at the ends of the photosensitive member unit 8 and developing unit 4 in the longitudinal direction, so as to surround the photosensitive drum 1. Although the regulated portions 4*j*, 4*k*, 8*j*, and 8*k* have been described as being distributed over both the photosensitive member unit 8 and the developing unit 4, these may be disposed on just one. The positions of the regulated portions 4*j*, 4*k*, 8*j*, and 8*k* are in generally the same position in the mounting direction of the process cartridge P (the direction of the arrow a in FIG. 10) as to the mounting portion 13*f* of the extracting member 13 illustrated in FIG. 10.

Mounting Operation of Process Cartridge

Figure 11:
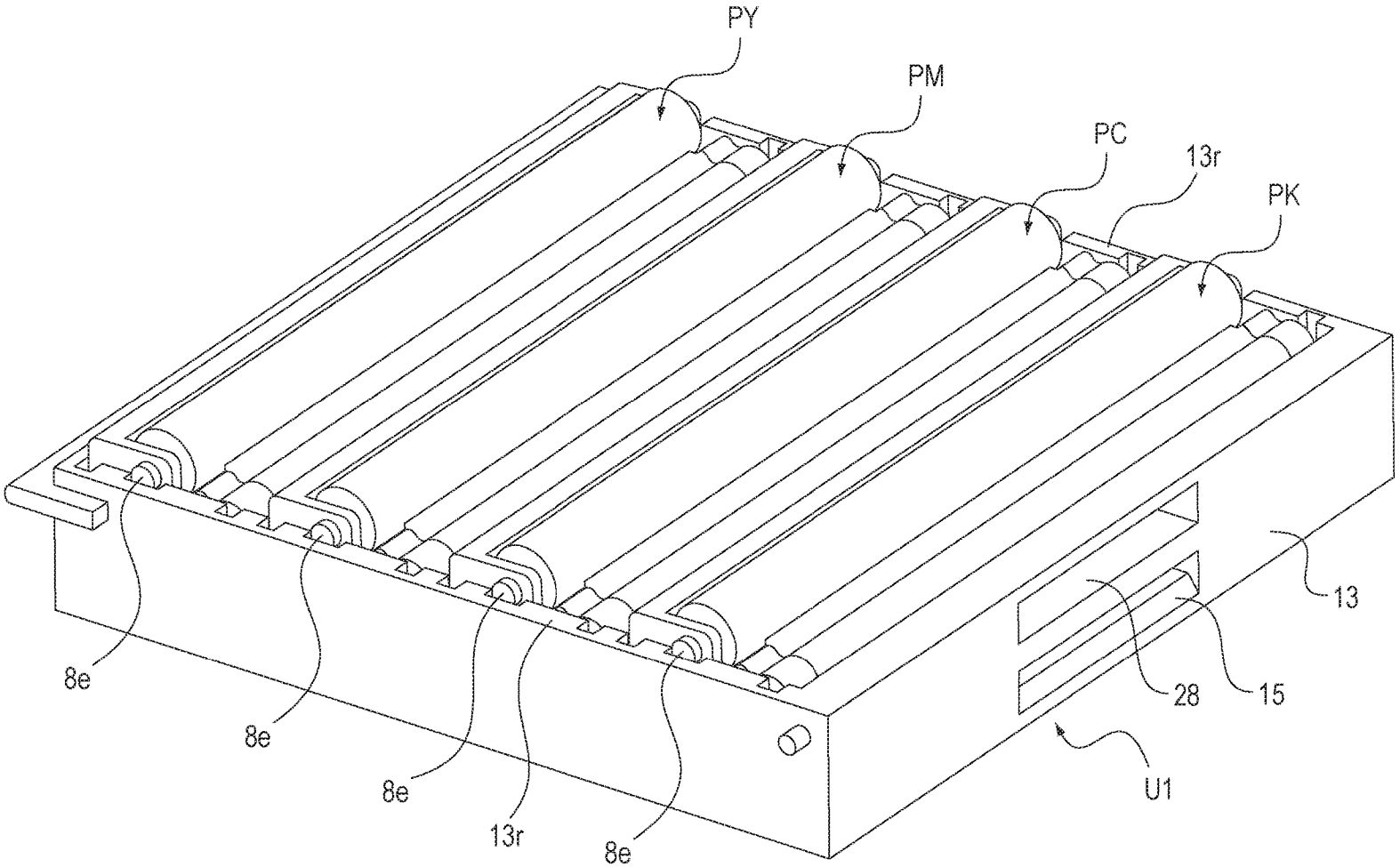
FIG. 11 is a perspective explanatory diagram illustrating cartridges mounted to the mounting portion of the supporting member, as viewed from the non-drive side.

The operation of mounting the process cartridges P to the mounting portions 13*f* of the extracting member 13 will be described next with reference to FIGS. 10, 11, 13A, and 13B. FIG. 10 is a perspective explanatory diagram illustrating the process cartridges P according to the present embodiment being mounted to the mounting portions 13*f* of the extracting member 13. FIG. 11 is a perspective explanatory diagram illustrating all of the process cartridges P having been mounted in the mounting portions 13*f* of the extracting member 13.

The process cartridges PY, PM, PC, and PK are each mounted in a respective one of four mounting portions 13*f* provided in the extracting member 13 illustrated in FIGS. 5 and 6, as illustrated in FIG. 11. The user mounts the process cartridges P in the direction of the arrow a in FIG. 10, which is substantially the gravitational direction.

Process cartridges P are mounted to the mounting portions 13*f* of the extracting member 13 as follows. The user inserts the cylinder regulated portions 4*j*, 4*k*, 8*j*, and 8*k* illustrated in FIGS. 7 and 10, that protrude from both ends of the process cartridge P in the longitudinal direction, as described below. As illustrated in FIG. 13A, the user inserts the regulated portions 4*j*, 4*k*, 8*j*, and 8*k* of the process cartridge P along the guide portions 13*h* through 13*k* that are grooves serving as rotation regulating portions provided to the mounting portion 13*f* of the extracting member 13 illustrated in FIGS. 5 and 6. Thus, the process cartridge P is guided by the guide portions 13*h* through 13*k* and mounted to the correct mounting position within the mounting portion 13*f* of the extracting member 13, as illustrated in FIG. 13B, and is mounted.

AS the process cartridge P is mounted into the mounting portion 13*f* of the extracting member 13, the positioned portions 8*d* and 8*e* provided to both ends of the process cartridge P in the longitudinal direction come into contact with the positioning portions 13*p* and 13*q* provided to the extracting member 13. The positioning portions 13*p* and 13*q* are formed as V-shapes, as illustrated in FIG. 13B. The cylinder positioned portions 8*d* and 8*e* provided to both ends of the process cartridge P in the longitudinal direction come into contact with the V-shaped positioning portions 13*p* and 13*q*. This enables positioning in the mounting direction of the process cartridge P (the direction of the arrow a in FIG. 10).

The rotation-regulated portions 8*f* and 8*g*, that have cross-sectional elliptic shapes and are provided to both ends of the process cartridge P in the longitudinal direction, as illustrated in FIGS. 7 and 10, behave as follows. Planar portions 8*f*1, 8*f*2, 8*g*1, and 8*g*2 of the rotation-regulated portions 8*f* and 8*g* come into contact with the side faces of the guide portions 13*i* and 13*j* provided to the extracting member 13 illustrated in FIGS. 5 and 6. Accordingly, the rotational posture of the process cartridge P in the circumferential direction indicated by the arrow X in FIG. 13A can be positioned. Note that the rotation-regulated portion 8*f* is provided to the opposite side from the rotation-regulated portion 8*g*, and accordingly is not illustrated in FIGS. 13A and 13B.

The positioning of the process cartridge P within the mounting portion 13*f* of the extracting member 13 is determined by the positioned portions 8*d* and 8*e*, and rotation-regulated portions 8*f* and 8*g*, provided to both ends of the process cartridge P in the longitudinal direction, as illustrated in FIGS. 7 and 10.

The regulated portions 4*j*, 4*k*, 8*j*, and 8*k* provided to both ends of the process cartridge P in the longitudinal direction, as illustrated in FIGS. 7 and 10, each retract into retracting portions 13*h*1, 13*i*1, 13*j*1, and 13*k*1, respectively provided below the guide portions 13*h* through 13*k* serving as the rotation regulating portions provided to the mounting portion 13*f* of the extracting member 13, as illustrated in FIGS. 5 and 6. At the retracted positions thereof, the regulated portions 4*j*, 4*k*, 8*j*, and 8*k* do not come into contact with the side faces of the guide portions 13*h* through 13*k* provided to the mounting portion 13*f* of the extracting member 13, as illustrated in FIG. 13B.

Accordingly, the regulated portions 4*j*, 4*k*, 8*j*, and 8*k* do not obstruct positioning of the process cartridge P as to the mounting portion 13*f* of the extracting member 13.

Figure 20:
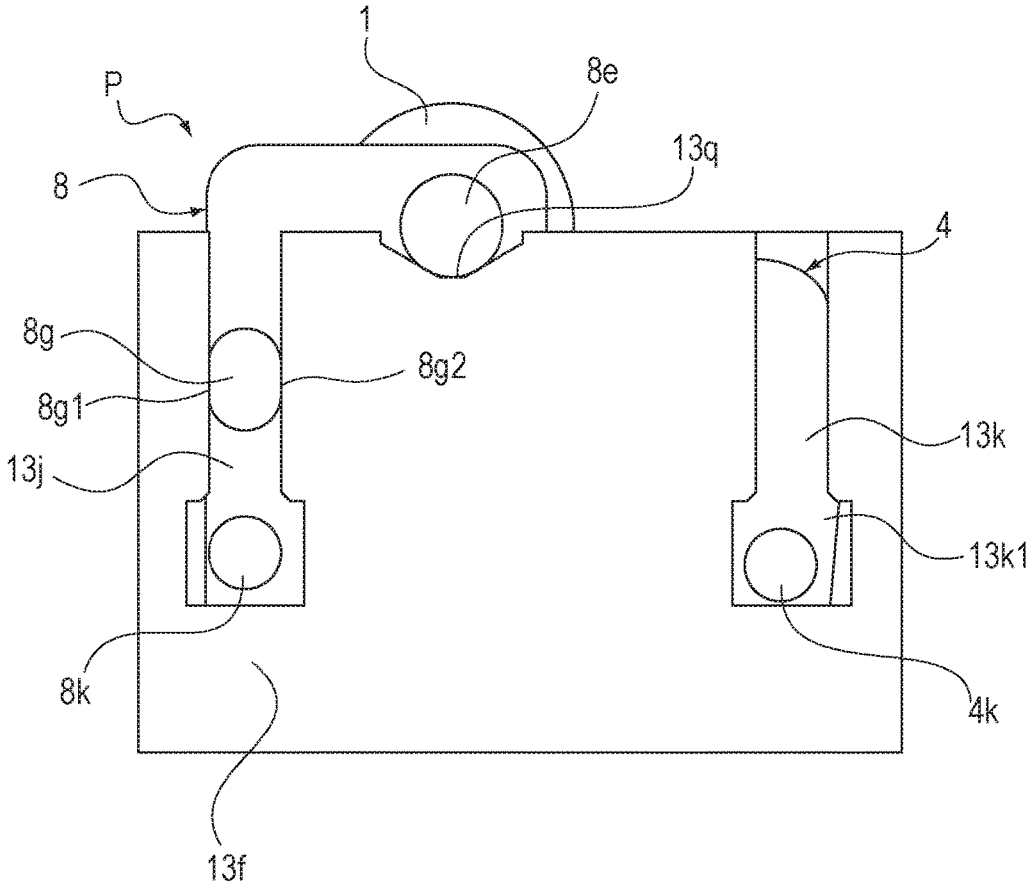
FIG. 20 is a cross-sectional explanatory diagram illustrating mounting of the cartridge to the mounting portion of the supporting member having been completed.

FIG. 20 illustrates a state where the developing roller 40 is separated from the photosensitive drum 1, when the process cartridge P is positioned as to the extracting member 13 and the extracting member 13 is positioned within the image forming apparatus 100 main unit. When the developing unit 4 moves as to the extracting member 13 for the developing roller 40 to separate from the photosensitive drum 1, the regulated portions 4*j* and 4*k* also move in relation to the extracting member 13. The retracting portions 13*h*1 and 13*k*1 are configured so as to not come into contact with the regulated portions 4*j* and 4*k*, so as to not obstruct movement of the regulated portions 4*j* and 4*k* at this time.

Mounting Operation of Supporting Member

Next, the operation of mounting the extracting unit U1 provided with the extracting member 13 and LED unit 3 into the image forming apparatus 100 main unit will be described with reference to FIG. 12. FIG. 12 is a cross-sectional explanatory diagram illustrating the extracting unit U1 according to the present embodiment being mounted into the image forming apparatus 100 main unit.

The extracting unit U1 has guided portions 13*a* through 13*d* provided to the extracting member 13 illustrated in FIGS. 5 and 6, as illustrated in FIG. 12. The guided portions 13*a* through 13*d* are mounted following the guide portions 14R and 14L provided to the side wall faces of the image forming apparatus 100 main unit illustrated in FIGS. 3 and 4, in the direction of the arrow D1 in FIG. 12.

As illustrated in FIG. 12, a configuration has been made where, when the door 10 opens as to the image forming apparatus 100 main unit, the intermediate transfer belt 5 retracts from the image forming position illustrated in FIG. 1. Accordingly, there is no concern of the surface of the photosensitive drum 1 and the outer peripheral surface of the intermediate transfer belt 5 rubbing against each other when performing the operation of moving the extracting unit U1 in the direction of arrows D1 and D2 in FIG. 12.

FIG. 1 illustrates a state where the door 10 is closed as to the image forming apparatus 100 main unit. The action of closing the door 10 causes the drum coupling members 25 and developing coupling members 26 illustrated in FIG. 3 to each protrude from the inner wall faces of the image forming apparatus 100 main unit, and enter the extracting unit U1.

Further, synchronously with the closing of the door 10, the intermediate transfer belt 5 descends. This, the surface of the photosensitive drum 1 comes into contact with the outer peripheral surface of the intermediate transfer belt 5 and is pressured. The positioned portions 8*d* and 8*e* provided to both ends of the process cartridge P in the longitudinal direction, illustrated in FIGS. 7 and 10, are thus pressed against the positioning portions 13*p* and 13*q* provided to the extracting member 13 illustrated in FIGS. 5 and 6.

Further, the abutting portion 10*a*1 of the pressing member 10*a* integrally disposed with the door 10 is inserted into the recess 15 of the extracting member 13 and abuts against the wall face of the recess 15, thereby pressing the extracting unit U1 to the left direction in FIG. 1. Thus, leading edges 13*a*1 and 13*b*1 of the guided portions 13*a* and 13*b* of the extracting member 13 illustrated in FIGS. 5 and 6 come into contact with rear end portions 14R1 and 14L1 of the guide portions 14R and 14L serving as the rotation regulating portions illustrated in FIGS. 3 and 4. These operations position the extracting unit U1 in the image forming apparatus 100 main unit. The process cartridges P stored in the mounting portions 13*f* of the extracting member 13 are also positioned within the image forming apparatus 100 main unit.

Rotational Regulation when Mounting Cartridge

The configuration that serves as a rotation regulating unit when mounting the process cartridge P will be described next with reference to FIGS. 13A and 13B. As illustrated in FIGS. 13A and 13B, the LED unit 3 is erected in the mounting portion 13*f* of the extracting member 13. The LED unit 3 is situated below the process cartridge P mounted into the mounting portion 13*f* of the extracting member 13.

The LED unit 3 serving as the image exposing member is erected at the mounting portion 13*f* of the extracting member 13 toward the surface of the photosensitive drum 1 at a position overlapping the first and second frames 8*a* and 4*a* of the process cartridge P, in relation to the mounting direction of the process cartridge P indicated by the arrow a in FIG. 13A. When mounting the process cartridge P to the mounting portion 13*f* of the extracting unit U1, the first and second frames 8*a* and 4*a* of the process cartridge P need to be of a configuration where they do not interfere with the LED unit 3.

In the present embodiment, the cylindrical regulated portions 4*j*, 4*k*, 8*j*, and 8*k* protrude at both ends of the process cartridge P in the longitudinal direction, as illustrated in FIGS. 7 and 10. Further, the mounting portion 13*f* of the extracting member 13 is provided with the guide portions 13*h* through 13*k* that are grooves serving as rotation regulating portions into which wall faces the outer perimeters of the regulated portions 4*j*, 4*k*, 8*j*, and 8*k* come into contact, as illustrated in FIGS. 5 and 6.

In a case where the process cartridge P is to be mounted in the mounting portion 13*f* of the extracting member 13 as illustrated in FIG. 13A, the regulated portions 8*k* and 4*k* provided protruding from one end of the process cartridge P in the longitudinal direction as illustrated in FIG. 10 are guided into the guide portions 13*j* and 13*k* serving as rotation regulating portions provided to the mounting portion 13*f* of the extracting member 13 illustrated in FIG. 5, whereby the process cartridge P is mounted.

At this time, the cylindrical regulated portions 8*k* and 4*k* provided protruding from one end of the process cartridge P in the longitudinal direction as illustrated in FIG. 10 enter the groove portions of the guide portions 13*j* and 13*k* serving as rotation regulating portions provided to the mounting portion 13*f* of the extracting member 13 illustrated in FIG. 5. The outer peripheral surfaces of the cylindrical regulated portions 8*k* and 4*k* are in sliding contact with the wall faces of the grooves of the guide portions 13*j* and 13*k*, there by positioning the posture of the process cartridge P in the rotation direction indicated by the arrow X in FIG. 13A. Thereafter, the first and second frames 8*a* and 4*a* of the process cartridge P and the LED unit 3 begin to overlap in the direction of the arrow a in FIG. 13A.

The process cartridge P is mounted to the mounting portion 13*f* of the extracting member 13 in the present embodiment. The regulated portions 4*j*, 4*k*, 8*j*, and 8*k* provided to both ends of the process cartridge P in the longitudinal direction as illustrated in FIGS. 7 and 10 are regulated at this time by the guide portions 13*h* through 13*k* serving as rotation regulating portions provided to the mounting portion 13*f* of the extracting member 13, illustrated in FIGS. 5 and 6. Thereafter, the first and second frames 8*a* and 4*a* of the process cartridge P and the LED unit 3, serving as an image exposing member, begin to overlap in the direction of mounting the process cartridge P, indicated by the arrow a in FIG. 13A.

FIG. 13A is a cross-sectional explanatory diagram illustrating the instant that the first and second frames 8*a* and 4*a* of the process cartridge P and the LED unit 3 overlap in the direction of the arrow a in FIG. 13A. At this time, the regulated portions 8*k* and 4*k* provided protruding at one end of the process cartridge P in the longitudinal direction, as illustrated in FIG. 10, are already in contact with the wall faces of the grooves of the guide portions 13*j* and 13*k* provided to the extracting member 13 illustrated in FIG. 5, and the positions thereof are regulated.

Accordingly, even in a case where the user happens to be grasping the process cartridge P and applies force to move the process cartridge P in the rotation direction indicated by the arrow X in FIG. 13A, the process cartridge P will not rotate in the direction of the arrow X in FIG. 13A. Thus, there is no danger of the first and second frames 8*a* and 4*a* of the process cartridge P coming into contact with the LED unit 3. Thereafter, the LED unit 3 erected within the mounting portion 13*f* of the extracting member 13 can be brought into proximity with the surface of the photosensitive drum 1, without coming into contact with the first and second frames 8*a* and 4*a* of the process cartridge P mounted in the mounting portion 13*f*, as illustrated in FIG. 13B.

As illustrated in FIG. 13B, the rotation-regulated portions 8*f* and 8*g* according to the present embodiment have cross-sectional elliptic shapes and are provided to both ends of the process cartridge P in the longitudinal direction. The planar portions of the rotation-regulated portions 8*f* and 8*g* are in sliding contact with the wall faces of the grooves of the guide portions 13*i* and 13*j* serving as rotation regulating portions, thereby also positioning the rotational posture of the process cartridge P when forming images in the image forming apparatus 100 main unit. Finally, the LED unit 3 can be positioned as to the photosensitive drum 1 in a highly precise manner by introducing a spacing member such as a spacer or the like between the LED unit 3 and the photosensitive drum 1 or part of the first frame 8*a*.

On the opposite side of the process cartridge P in the longitudinal direction as well, the regulated portions 8*j* and 4*j* illustrated in FIG. 7 come into contact with the wall faces of the grooves of the guide portions 13*h* and 13*i* illustrated in FIG. 6. The LED unit 3 erected within the mounting portion 13*f* of the extracting member 13 is then brought into proximity with the surface of the photosensitive drum 1, without coming into contact with the first and second frames 8*a* and 4*a* of the process cartridge P mounted in the mounting portion 13*f*.

According to the present embodiment, when mounting the process cartridge P in the mounting portion 13*f* of the extracting member 13, the rotational posture of the process cartridge P as to the mounting portion 13*f* is positioned. Thereafter, the first and second frames 8*a* and 4*a* of the process cartridge P and the LED unit 3 erected in the mounting portion 13*f* overlap in the mounting direction of the process cartridge P (the direction of the arrow a in FIG. 13A). Accordingly, collision of the process cartridge P and the LED unit 3 can be avoided when the user mounts the process cartridge P in the mounting portion 13*f* of the extracting member 13.

The present embodiment is an example of the LED unit 3 having been erected within the mounting portion 13*f* of the extracting member 13. Alternatively, an arrangement may be made where the image exposing member is disposed within the image forming apparatus 100 main unit, and mounting of the process cartridge P is performed by retracting the intermediate transfer belt 5 upwards, and performing mounting of the process cartridge P from above the image forming apparatus 100 main unit.

Description has been made in the present embodiment regarding an example of a process cartridge P configured having the photosensitive member unit 8 and the developing unit 4. Alternatively, the present embodiment is also applicable to a configuration where the developing unit 4 and photosensitive member unit 8 are separately exchangeable.

Description has been made in the present embodiment regarding an example of a case of having the intermediate transfer belt 5 as an example of a transfer-receiving member. Alternatively, the present embodiment is also applicable to a configuration where the recording medium S serving as a transfer-receiving member is conveyed to a position facing the photosensitive drum 1 by the conveying unit, and the toner image formed on the surface of the photosensitive drum 1 is directly transferred onto the recording medium S.

Positional Regulation for when Erroneously Mounting Cartridge

Figure 14:
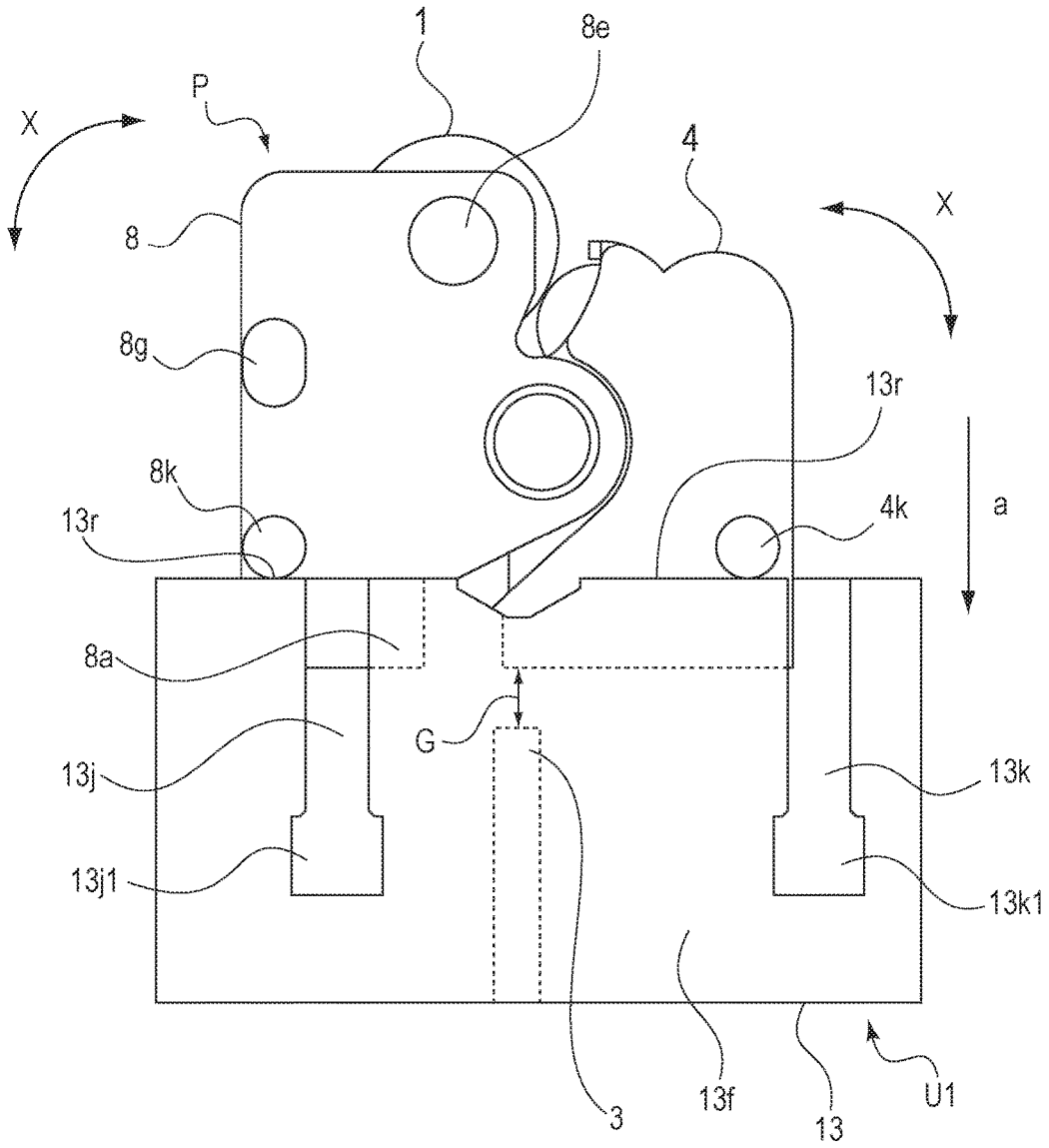
FIG. 14 is a cross-sectional explanatory diagram illustrating the cartridge having been erroneously mounted to the mounting portion of the supporting member.

Description will be made regarding the configuration of position regulating portions for when erroneously mounting the process cartridge P, with reference to FIGS. 13A through 14. The LED unit 3 is erected in the mounting portion 13*f* of the extracting member 13, as illustrated in FIGS. 13A through 14. The LED unit 3 is situated below the process cartridge P mounted in the mounting portion 13*f*.

The LED unit 3 serving as an image exposing member is erected at the mounting portion 13*f* of the extracting member 13 toward the surface of the photosensitive drum 1 at a position overlapping the first and second frames 8*a* and 4*a* of the process cartridge P, in relation to the mounting direction of the process cartridge P indicated by the arrow a in FIG. 13A. The extracting member 13 is configured such that the upstream side of the light emitting surface 3*a*1 is opened, with regard to mounting the process cartridge P to the mounting portion 13*f* in the mounting direction a, as illustrated in FIG. 2. Accordingly, when mounting the process cartridge P to the mounting portion 13*f* of the extracting unit U1, the first and second frames 8*a* and 4*a* of the process cartridge P need to be of a configuration where they do not interfere with the LED unit 3, even if the user errs regarding the mounting position of the process cartridge P.

Cylindrical regulated portions 4*j*, 4*k*, 8*j*, and 8*k* are provided protruding at both ends of the process cartridge P in the longitudinal direction in the present embodiment, as illustrated in FIGS. 7 and 10. Further, a regulating portion 13*r* that comes into contact with the outer perimeter of the regulated portions 4*j*, 4*k*, 8*j*, and 8*k*, is provided to the mounting portion 13*f* of the extracting member 13, as illustrated in FIG. 14. It can be seen from FIG. 14 that the regulating portion 13*r* provided on the mounting portion 13*f* of the extracting member 13 is disposed on the mounting portion 13*f* at the upstream side in the mounting direction of the process cartridge P in the direction of the arrow a in FIG. 14.

Mounting the process cartridge P to the correct mounting position in the mounting portion 13*f* of the extracting member 13 is performed as follows, as illustrated in FIG. 13A. The cylindrical regulated portions 8*k* and 4*k* provided protruding from one end of the process cartridge P in the longitudinal direction as illustrated in FIG. 10 are inserted (engaged) into the guide portions 13*j* and 13*k* formed of grooves, without coming into contact with the regulating portion 13*r* which is the top end face of the mounting portion 13*f* of the extracting member 13 and are guided while sliding in contact with the wall faces of the grooves of the guide portions 13*j* and 13*k*, whereby the process cartridge P is mounted. Thus, the LED unit 3 can be brought into proximity with the surface of the photosensitive drum 1, without coming into contact with the first and second frames 8*a* and 4*a* of the process cartridge P, as illustrated in FIG. 13B.

However, it is conceivable that there will be cases where the user erroneously attempts to mount the process cartridge P at a position different from the correct mounting position of the mounting portion 13*f* of the extracting member 13 (a deviated position), as illustrated in FIG. 14. That is to say, a case is conceivable where mounting is attempted to a position where the regulated portions 8*k* and 4*k* are not inserted (engaged) into the guide portions 13*j* and 13*k*.

In this case, the cylindrical regulated portions 8*k* and 4*k* provided protruding at one end of the process cartridge P in the longitudinal direction come into contact with the regulating portion 13*r* which is the top end face of the mounting portion 13*f* of the extracting member 13, thereby regulating the position thereof, as illustrated in FIG. 14. The regulated portions 8*k* and 4*k* are formed on the first and second frames

8*a* and 4*a* of the process cartridge P. As mentioned earlier, the regulated portions 8*k* and 4*k* may be formed on just one of the photosensitive member unit 8 and developing unit 4. Thus, an arrangement has been made where the process cartridge P cannot enter the mounting portion 13*f* of the extracting member 13 in an erroneous manner.

Thus, the user can realize that the process cartridge P cannot be mounted to the mounting portion 13*f* of the extracting member 13 in that way. The user will then attempt to mount the process cartridge P to the correct mounting position in the mounting portion 13*f* of the extracting member 13.

Although not illustrated in FIG. 14, the same holds true for the opposite side of the process cartridge P in the longitudinal direction. The cylindrical regulated portions 8*j* and 4*j* provided protruding at the end of the process cartridge P in the longitudinal direction come into contact with the regulating portion 13*r* which is the top end face of the mounting portion 13*f* of the extracting member 13, thereby restricting any further entry. The regulated portions 8*j* and 4*j* are formed on the first and second frames 8*a* and 4*a* of the process cartridge P.

As illustrated in FIG. 14, the cylindrical regulated portions 4*j*, 4*k*, 8*j*, and 8*k* provided protruding at both ends of the process cartridge P in the longitudinal direction come into contact with the regulating portion 13*r* which is the top end face of the mounting portion 13*f* of the extracting member 13. A gap G is set to be formed between the first and second frames 8*a* and 4*a* of the process cartridge P and the LED unit 3 serving as an image exposing member at this time.

Accordingly, even when the user attempts to mount the process cartridge P at an incorrect mounting position in the mounting portion 13*f* of the extracting member 13, the first and second frames 8*a* and 4*a* of the process cartridge P do not come into contact with the LED unit 3, and thus damage to the LED unit can be avoided.

According to the image forming apparatus 100 of the present embodiment, the process cartridge P is mounted in the mounting portion 13*f* of the extracting member 13 having the LED unit 3 serving as an image exposing member. At this time, collision of the LED unit 3 and the first and second frames 8*a* and 4*a* of the process cartridge P can be avoided.

Note that the regulated portion 8*j* and regulated portion 4*j* are provided so as to surround the photosensitive drum 1 in the present embodiment, as illustrated in FIG. 7. Further, the regulated portion 8*k* and regulated portion 4*k* are provided so as to surround the photosensitive drum 1, as illustrated in FIG. 10.

Further, the regulated portion 8*j* and regulated portion 4*j* are on both sides of the LED unit 3 serving as the image exposing member in a state where the process cartridge P has been mounted to the correct mounting position within the mounting portion 13*f* of the extracting member 13, as illustrated in FIGS. 13A and 13B. Similarly, the regulated portion 8*k* and regulated portion 4*k* are on both sides of the LED unit 3 serving as the image exposing member.

In a case where the user attempts to mount the process cartridge P at an incorrect position in the mounting portion 13*f* of the extracting member 13, as illustrated in FIG. 14, the regulated portion 8*j* and regulated portion 4*j* illustrated in FIG. 7 come into contact with the regulating portion 13*r* which is the top end face of the mounting portion 13*f* of the extracting member 13. The regulated portion 8*k* and regulated portion 4*k* illustrated in FIG. 10 also come into contact with the regulating portion 13*r* which is the top end face of the mounting portion 13*f* of the extracting member 13. Thus, the rotational posture of the process cartridge P in the circumferential direction indicated by the arrow X in FIG. 14 can also be regulated. Thus, a gap G can be set in a sure manner between the first and second frames 8*a* and 4*a* of the process cartridge P and the LED unit 3, as illustrated in FIG. 14.

Note that a configuration may be made where just one of the regulated portion 8*j* and regulated portion 4*j* illustrated in FIG. 7 is provided. Similarly, a configuration may be made where just one of the regulated portion 8*k* and regulated portion 4*k* illustrated in FIG. 10 is provided. That is to say, if the user attempts to mount the process cartridge P at an erroneous position within the mounting portion 13*f* of the extracting member 13, but the process cartridge P cannot be rotated in the circumferential direction at that time, the gap G can be established between the first and second frames 8*a* and 4*a* of the process cartridge P and the LED unit 3.

Description has been made in the present embodiment regarding an example of the image forming apparatus 100 where the LED unit 3 is erected within the mounting portion 13*f* of the extracting member 13. Alternatively, an arrangement may be made where the image exposing member is disposed within the image forming apparatus 100 main unit, and mounting of the process cartridge P is performed by retracting the intermediate transfer belt 5 upwards.

Description has been made in the present embodiment regarding an example of a process cartridge P configured having the photosensitive member unit 8 and the developing unit 4. Alternatively, the present embodiment is also applicable to a configuration where the developing unit 4 and photosensitive member unit 8 are separately exchangeable as cartridges. In this case, the regulating portion 13*r* needs to be provided on both cartridges of the photosensitive member unit 8 and developing unit 4, or just the cartridge of the photosensitive member unit 8.

Description has been made in the present embodiment regarding an example of a case of having the intermediate transfer belt 5 as an example of a transfer-receiving member. Alternatively, the present embodiment is also applicable to a configuration where the recording medium S that is a sheet material or the like serving as a transfer member is conveyed to the surface of the photosensitive drum 1, and the toner image (developed image) formed on the surface of the photosensitive drum 1 is directly transferred onto the recording medium S.

Second Embodiment

Next, description will be made regarding the configuration of a second embodiment of the image forming apparatus according to the present invention, with reference to FIG. 15. Note that configurations that are the same as with the first embodiment will be referred to by the same part names, regardless of whether denoted by the same reference numeral or different reference numerals, and description thereof will be omitted.

Description has been made in the first embodiment that cylinder regulated portions 4*j*, 4*k*, 8*j*, and 8*k* protruding at both ends of the process cartridge P in the longitudinal direction, illustrated in FIGS. 7 and 10, are used. In a case where the user attempts to mount the process cartridge P at an incorrect position in the mounting portion 13*f* of the extracting member 13, as illustrated in FIG. 14, the outer peripheral surfaces of the regulated portions 4*j*, 4*k*, 8*j*, and 8*k* come into contact with the regulating portion 13*r* which is the top end face of the mounting portion 13*f* of the extracting member 13, and the position thereof is regulated. Thus, a gap G is formed between the first and second frames 8*a* and 4*a* of the process cartridge P and the LED unit 3, in this example.

Figure 15:
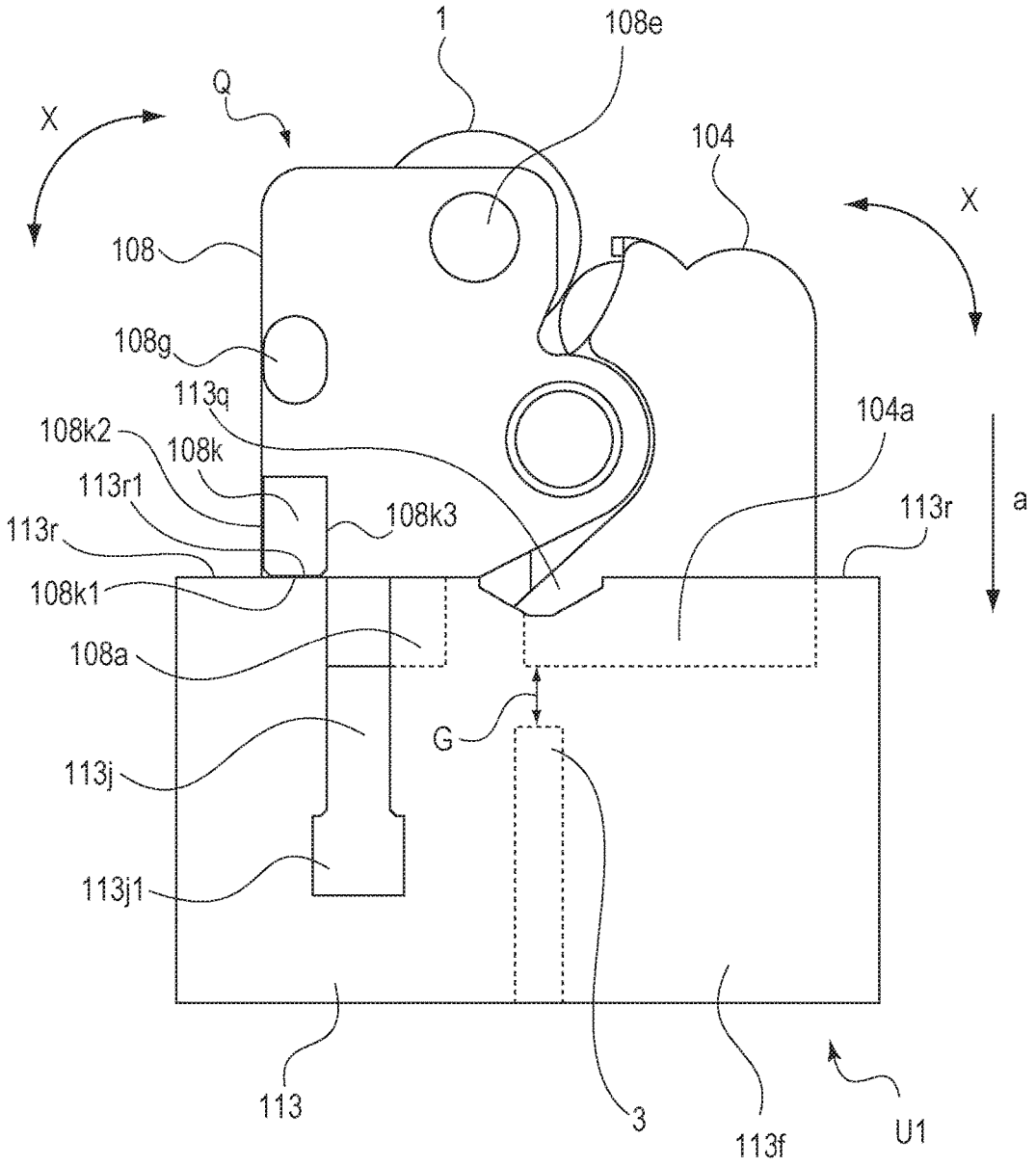
FIG. 15 is a cross-sectional explanatory diagram illustrating the cartridge of the image forming apparatus having been erroneously mounted to the mounting portion of the supporting member.

In the present embodiment, in a case where the user attempts to mount a process cartridge Q at an erroneous position within a mounting portion 113*f* of an extracting member 113, just regulated portions 108*j* and 108*k* that have a generally rectangular cross-sectional shape and are provided protruding at both ends of the process cartridge Q in the longitudinal direction, come into contact with the regulating portion 113*r* which is the top end face of the mounting portion 113*f* of the extracting member 113, as illustrated in FIG. 15. This prevents the process cartridge Q from being mounted. Thus, a configuration has been made that generates a gap G between the first and second frames 108*a* and 104*a* of the process cartridge Q and the LED unit 3. Note that the regulated portion 108*j* is provided on the opposite side from the regulated portion 108*k*, and accordingly is not illustrated in FIG. 15.

The downstream end portions of the regulated portions 108*j* and 108*k* in the mounting direction of the process cartridge Q, indicated by the arrow a in FIG. 15, are made up of planar portions 108*j*1 and 108*k*1. On the other hand, the regulating portion 113*r* which is the top end face of the mounting portion 113*f* of the extracting member 113 is made up of a planar portion 113*r*1.

As illustrated in FIG. 15, in a case where the user attempts to mount the process cartridge Q at an erroneous position within the mounting portion 113*f* of the extracting member 113, planar portions 108*j*1 and 108*k*1 of the regulated portions 108*j* and 108*k* provided protruding at both ends of the process cartridge Q in the longitudinal direction come into contact with the planar portion 113*r*1 of the regulating portion 113*r* which is the top end face of the mounting portion 113*f* of the extracting member 113, thus preventing mounting of the process cartridge Q. In the present embodiment, the contact between the regulated portions 108*j* and 108*k* and the regulating portion 113*r* takes place between the planar portions 108*j*1 and 108*k*1 and the planar portion 113*r*1.

Guide portions 113*i* and 113*j* formed of grooves provided on the mounting portion 113*f* of the extracting member 113 are configured as rotation regulating portions regulating the rotational posture of the process cartridge Q in the circumferential direction, in a state where the process cartridge Q has been mounted in the correct mounting position in the mounting portion 113*f* of the extracting member 113, as illustrated in FIG. 15. Note that the guide portion 113*i* is provided on the opposite side from the guide portion 113*j*, and accordingly is not illustrated in FIG. 15.

The regulated portions 108*j* and 108*k* are provided protruding at both ends of the process cartridge Q, on the first frame 108*a* of the process cartridge Q in the longitudinal direction. Planar portions 108*j*2, 108*j*3, 108*k*2, and 108*k*3 of the regulated portions 108*j* and 108*k* are in sliding contact with the wall faces of the guide portions 113*i* and 113*j* formed of grooves to serve as rotation regulating portions, and thus are regulated. This regulates the rotational posture of the process cartridge Q in the circumferential direction. Thus, in the same way as in the first embodiment, a gap G is set to be formed between the first and second frames 108*a* and 104*a* of the process cartridge Q and the LED unit 3 in the present embodiment as well.

In the present embodiment, the downstream end portions of the regulated portions 108*j* and 108*k*, protruding at both ends of the process cartridge Q in the longitude direction, in the mounting direction of the process cartridge Q (direction of the arrow a in FIG. 15), are the planar portions 108*j*1 and 108*k*1. Further, the regulating portion 113*r* which is the top end face of the mounting portion 113*f* of the extracting member 113 is the planar portion 113*r*1.

In the present embodiment, providing one of the regulated portions 108*j* and 108*k* each at both ends of the process cartridge Q in the longitudinal direction is sufficient. The planar portions 108*j*1 and 108*k*1 of the regulated portions 108*j* and 108*k* protruding at both ends of the process cartridge Q in the longitudinal direction are in planar contact with the planar portion 113*r*1 of the regulating portion 113*r* which is the top end face of the mounting portion 113*f* of the extracting member 113.

Accordingly, the rotational posture of the process cartridge Q in the circumferential direction indicated by the arrow X in FIG. 15 is regulated. Thus the process cartridge Q will not rotate on the planar portions 108*j*1 and 108*k*1 in the circumferential direction indicated by the arrow X in FIG. 15, and there is no concern of the first and second frames 108*a* and 104*a* of the process cartridge Q coming into contact with the LED unit 3.

According to the present embodiment, it is sufficient for one each of the regulated portions 108*j* and 108*k* to be provided at both ends of the process cartridge Q in the longitudinal direction, as in the first embodiment illustrated in FIGS. 5 and 6. Accordingly, there is no need to provide guide portions 13*h* and 13*k* made of grooves that accept the regulated portions 4*j* and 4*k* illustrated in FIGS. 7 and 10 on the mounting portion 13*f* of the extracting member 13. Accordingly, the rigidity of the extracting member 113 is improved, and vibration and the like when forming images can be suppressed.

Note that in FIG. 15, reference numeral 104 denotes a developing unit, 108 a photosensitive member unit, 108*e* a positioning portion, 108*g* a rotation-regulated portion, 113*q* a positioning portion, 113*j* a guide portion, and 113*j*1 a retracting portion. Other configurations are configured in the same way as in the first embodiment, and the same advantages can be obtained.

Third Embodiment

Next, description will be made regarding the configuration of a third embodiment of the image forming apparatus according to the present invention, with reference to FIG. 16. Note that configurations that are the same as with the above embodiments will be referred to by the same part names, regardless of whether denoted by the same reference numeral or different reference numerals, and description thereof will be omitted.

Description has been made in the first embodiment that cylinder regulated portions 4*j*, 4*k*, 8*j*, and 8*k* protruding at both ends of the process cartridge P in the longitudinal direction, illustrated in FIGS. 7 and 10, are used. In a case where the user attempts to mount the process cartridge P at an incorrect position in the mounting portion 13*f* of the extracting member 13, as illustrated in FIG. 14, the outer peripheral surfaces of the regulated portions 4*j*, 4*k*, 8*j*, and 8*k* come into contact with the regulating portion 13*r* which is the top end face of the mounting portion 13*f* of the extracting member 13, and the position thereof is regulated. Thus, a gap G is formed between the first and second frames 8*a* and 4*a* of the process cartridge P and the LED unit 3, in this example.

In the present embodiment, an example will be described where the rotational posture of a process cartridge R mounted within a mounting portion 213*f* of an extracting member 213 in the circumferential direction indicated by arrow X in FIG. 16 will be described. Rotation-regulated portions 208*g* that have cross-sectional elliptic shapes and are provided to both ends of the process cartridge R in the longitudinal direction, come into contact with the regulating portion 213*r* which is the top end face of the mounting portion 213*f* of the extracting member 213. Thus mounting of the process cartridge R is prevented, and a gap G is formed between the first and second frames 208*a* and 4*a* of the process cartridge R and the LED unit 3. Other configurations and operations are the same as those in the first embodiment, so redundant description will be omitted.

Figure 16:
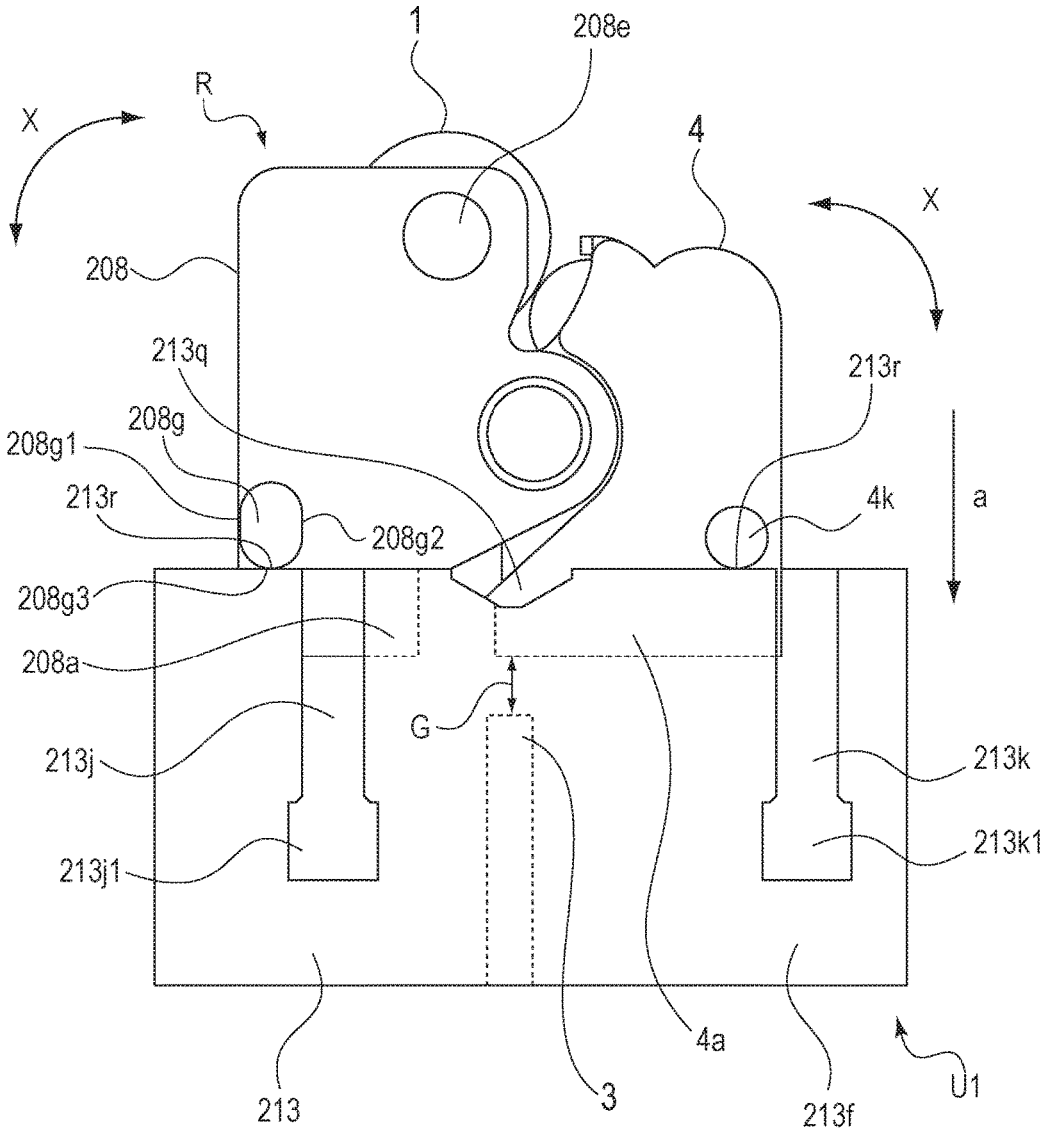
FIG. 16 is a cross-sectional explanatory diagram illustrating the cartridge of the image forming apparatus having been erroneously mounted to the mounting portion of the supporting member.

As illustrated in FIG. 16, the process cartridge R according to the present embodiment uses the same developing unit 4 as the first embodiment. On the other hand, the photosensitive member unit 208 uses the following configuration instead of the cylinder regulated portions 8*j* and 8*k* in the first embodiment illustrated in FIGS. 7 and 10. Rotation-regulated portions 208*g* and 208*f* that have cross-sectional elliptic shapes and are provided to both ends of the process cartridge R of the first frame 208*a* of the photosensitive member unit 208 in the longitudinal direction, are used. Note that the rotation-regulated portion 208*f* is provided on the opposite side from the rotation-regulated portion 208*g*, and accordingly is not illustrated in FIG. 16.

If the user erroneously attempts to mount the process cartridge R at a position different from the correct mounting position of the mounting portion 213*f* of the extracting member 213 (a deviated position), as illustrated in FIG. 16, the rotation-regulated portions 208*g* and 208*f* that have cross-sectional elliptic shapes and are provided protruding at both ends of the process cartridge R in the longitudinal direction come into contact with the regulating portion 213*r* which is the top end face of the mounting portion 213*f* of the extracting member 213, thereby preventing mounting of the process cartridge R. Thus, a gap G is set between the first and second frames 208*a* and 4*a* of the process cartridge R, and the LED unit 3, in the same way as the first embodiment.

In the present embodiment, in a state where the process cartridge R is mounted to the correct mounting position of the mounting portion 213*f* of the extracting member 213, the rotation-regulated portions 208*f* and 208*g* serving as regulated portions, and regulated portions 4*j* and 4*k*, provided to the first and second frames 208*a* and 4*a* of the process cartridge R, are each provided on both sides across the LED unit 3 serving as the image exposing member. Note that the rotation-regulated portion 208*f* and regulated portion 4*j* are provided on the opposite side from the rotation-regulated portion 208*g* and regulated portion 4*k*, and accordingly are not illustrated in FIG. 16.

In a state where the process cartridge R is mounted at the correct mounting position in the mounting portion 213*f* of the extracting member 213 in FIG. 16, the guide portions 213*i* and 213*j* formed of grooves provided to the mounting portion 213*f* of the extracting member 213 are configured as rotation regulating portions that regulate the rotational posture of the process cartridge R in the circumferential direction indicated by the arrow X in FIG. 16. Note that the guide portion 213*i* is provided to the opposite side from the guide portion 213*j*, and accordingly is not illustrated in FIG. 16.

The rotation-regulated portions 208*f* and 208*g* serving as regulated portions are provided protruding at both ends of the first frame 208*a* of the process cartridge R in the longitudinal direction of the process cartridge R. planar portions 208*f*1, 208*f*2, 208*g*1, and 208*g*2, of the rotation-regulated portions 208*f* and 208*g* are in sliding contact with the wall faces of the guide portions 213*i* and 213*j* that are grooves serving as rotation regulating portions. This regulates the rotational posture of the process cartridge R in the circumferential direction indicated by the arrow X in FIG. 16. Note that the rotation-regulated portion 208*f* serving as a regulated portion is provided to the opposite side from the rotation-regulated portion 208*g*, and accordingly is not illustrated in FIG. 16.

In the present embodiment, the rotation-regulated portions 208*f* and 208*g* that have cross-sectional elliptic shapes and are provided protruding at both ends of the photosensitive member unit 208 in the longitudinal direction and have the same function as the regulated portions 8*j* and 8*k* in the first embodiment, illustrated in FIG. 14. Accordingly, there is no need to provide the mounting portion 213*f* of the extracting member 213 with the retracting portions 13*j*1 and 13*i*1 illustrated in FIGS. 5 and 6 to prevent collision with the post-shaped regulated portions 8*j* and 8*k*, which were provided in the first embodiment illustrated in FIG. 14. Thus, the rigidity of the extracting member 213 is improved, and vibration and the like when forming images can be suppressed.

The downstream end portions of the rotation-regulated portions 208*f* and 208*g* may be planar portions, as in the second embodiment illustrated in FIG. 15. This does away with the need to provide the regulated portions 4*j* and 4*k* protruding at both ends of the process cartridge R in the longitudinal direction, to regulate the rotational posture of the in the circumferential direction of the process cartridge R indicated by the arrow X in FIG. 16.

Guide portions 213*h* and 213*k* formed of grooves in the mounting portion 213*f* of the extracting member 213 do not have to be formed. Accordingly, the rigidity of the extracting member 213 is improved, and vibration and the like when forming images can be suppressed. Note that in FIG. 16, reference numeral 208*e* denotes a rotation-regulated portion, 213*q* a positioning portion, 213*j* a guide portion, and 213*j*1 a retracting portion. Other configurations are configured in the same way as in the first embodiment, and the same advantages can be obtained.

Fourth Embodiment

Next, description will be made regarding the configuration of a fourth embodiment of the image forming apparatus according to the present invention, with reference to FIG. 17. Note that configurations that are the same as with the first embodiment will be referred to by the same part names, regardless of whether denoted by the same reference numeral or different reference numerals, and description thereof will be omitted.

In the first embodiment, the rotational posture of the process cartridge P within the mounting portion 13*f* of the extracting member 13 as to the LED unit 3 is positioned using the cylindrical regulated portions 4*j*, 4*k*, 8*j*, and 8*k* provided protruding at both ends of the process cartridge P in the longitudinal direction, as illustrated in FIGS. 7 and 10. In the present embodiment, rotational posture of the process cartridge Q1 within the mounting portion 113*f* of the extracting member 113 as to the LED unit 3 is positioned only using the rotation-regulated portions 108*f* and 108*g* that have cross-sectional elliptic shapes and are provided protruding at both ends of the photosensitive member unit 108 of the process cartridge Q1 in the longitudinal direction, as illustrated in FIG. 17.

Figure 17:
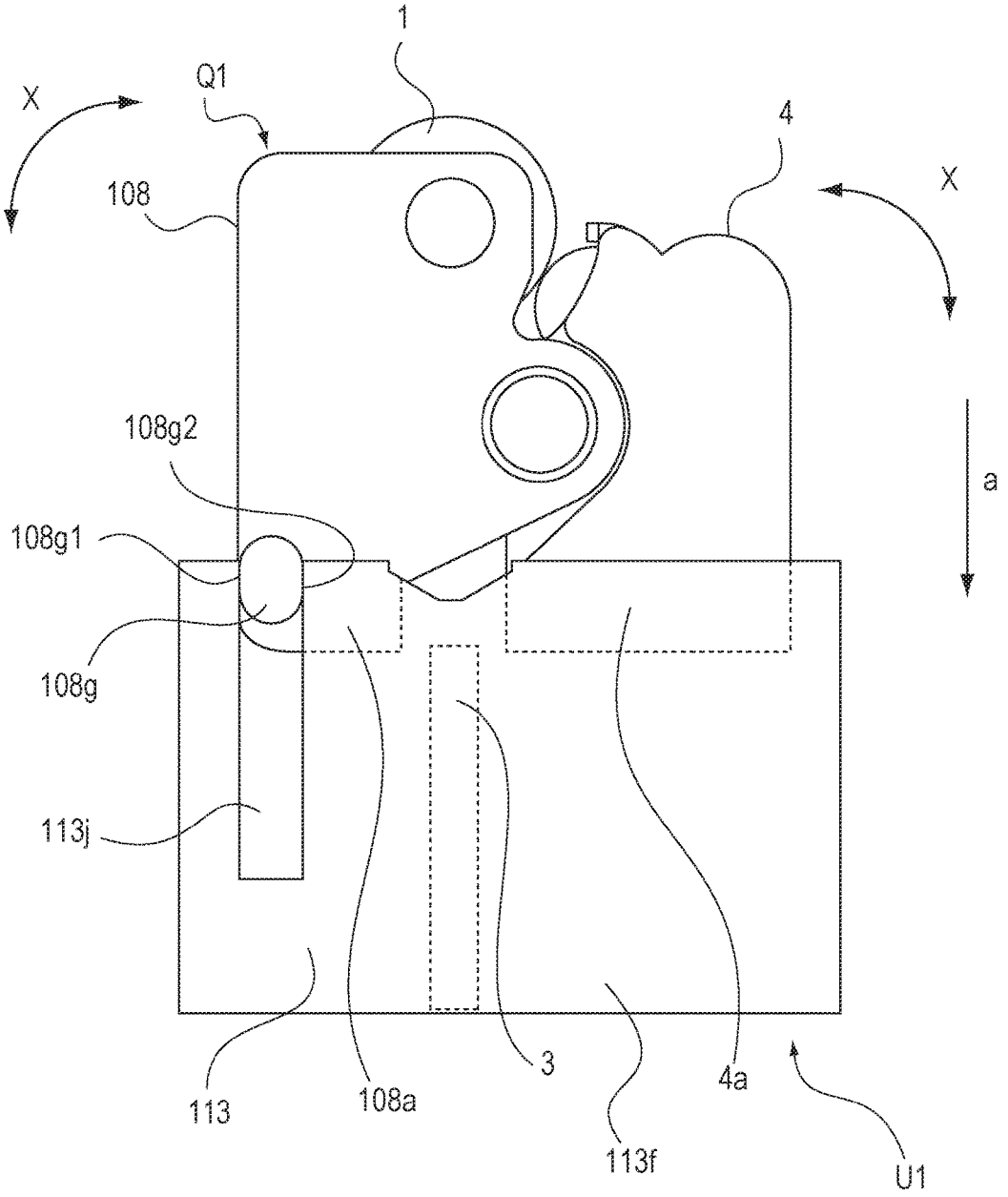
FIG. 17 is a cross-sectional explanatory diagram illustrating the cartridge of the image forming apparatus being mounted to the mounting portion of the supporting member.

The rotation-regulated portion 108*f* is provided to the opposite side of the process cartridge Q1 from the rotation-regulated portion 108*g* in the longitudinal direction in FIG. 17, and accordingly is not illustrated in FIG. 17. Other configurations and operations are the same as those in the first embodiment, so redundant description will be omitted.

When mounting the process cartridge Q1 to the mounting position in the mounting portion 113*f* of the extracting member 113 in the present embodiment, the rotation-regulated portion 108*g* that has a cross-sectional elliptic shape and is provided protruding at one end of the process cartridge Q1 in the longitudinal direction is guided into the groove of the rotation regulating portion 113*j* provided to the extracting member 113, and thus the process cartridge Q1 is mounted, as illustrated in FIG. 17. At this time, the rotation-regulated portion 108*g* enters the groove of the rotation regulating portion 113*j*, and the posture of the process cartridge Q1 in the rotational direction indicated by the arrow X in FIG. 17 is positioned.

The rotation regulating portion 113*j* provided to the mounting portion 113*f* of the extracting member 113 according to the present embodiment is configured of a groove provided along the mounting direction of the process cartridge Q1 indicated by the arrow a in FIG. 17. On the other hand, the rotation-regulated portions 108*g* that have a cross-sectional elliptic shape and are provided protruding at both ends of the process cartridge Q1 in the longitudinal direction is configured having planar portions 108*g*1 and 108*g*2 that have widths corresponding to the width of the groove of the rotation regulating portion 113*j*.

Thereafter, the rotation-regulated portion 108*g* is inserted in the groove of the rotation regulating portion 113*j*. The wall faces of the rotation regulating portion 113*j* and the planar portions 108*g*1 and 108*g*2 of the rotation-regulated portion 108*g* are in sliding contact. This positions the posture of the process cartridge Q1 in the rotational direction indicated by the arrow X in FIG. 17. Thereafter, the first and second frames 108*a* and 4*a* of the process cartridge Q1 and the LED unit 3 begin to overlap in the direction of mounting of the process cartridge Q1, indicated by the arrow a in FIG. 17.

Note that the rotation-regulated portion 108*f* that is on the opposite side from the rotation-regulated portion 108*g* in the longitudinal direction of the process cartridge Q1 in FIG. 17 acts the same as to the rotation regulating portion made up of a groove provided in the mounting portion 113*f* of the extracting member 113, although omitted from illustration.

The rotation-regulated portion 108*g* that has a cross-sectional elliptic shape is configured having the planar portions 108*g*1 and 108*g*2 in the present embodiment, as illustrated in FIG. 17. The planar portions 108*g*1 and 108*g*2 coming into sliding contact with the wall faces of the groove of the rotation regulating portion 113*j*, thereby regulating the posture of the process cartridge Q1 in the rotational direction indicated by the arrow X in FIG. 17.

FIG. 17 is a cross-sectional explanatory diagram illustrating the instant that the first and second frames 108*a* and 4*a* of the process cartridge Q1 and the LED unit 3 erected in the mounting portion 113*f* of the extracting member 113 overlap in the direction of mounting the process cartridge Q1 indicated by the arrow a in FIG. 17.

At this time, the rotation-regulated portion 108*g* that has a cross-sectional elliptic shape and is provided protruding at one end of the process cartridge Q1 in the longitudinal direction is already regulated by the rotation regulating portion 113*j* made up of a groove provided in the mounting portion 113*f* of the extracting member 113. Accordingly, there is no concern of the first and second frames 108*a* and 4*a* of the process cartridge Q1 coming into contact with the LED unit 3, in the same way as in the first embodiment.

According to the present embodiment, the rotation-regulated portion 108*g* that has a cross-sectional elliptic shape and is provided protruding at one end of the process cartridge Q1 in the longitudinal direction has the same operations as the rotation-regulated portion 8*g* according to the first embodiment illustrated in FIG. 10, and also serves to position the rotational posture of the process cartridge Q1 within the image forming apparatus 100 main unit when forming images.

In the present embodiment, only one each of the rotation-regulated portions 108*g* and 108*f* that have cross-sectional elliptic shapes and protrude at both ends of the process cartridge Q1 in the longitudinal direction needs to be formed. There is no need to provide the guide portions 13*h* and 13*k* in FIGS. 5 and 6, that are grooves in the extracting member 113 as in the case of the first embodiment. The guide portions 13*h* and 13*k* accept the cylinder regulated portions 4*j* and 4*k* provided protruding at both ends of the process cartridge Q1 illustrated in FIGS. 7 and 10 in the longitudinal direction. Accordingly, the rigidity of the extracting member 113 is improved, and vibration and the like when forming images can be suppressed. Other configurations are configured in the same way as in the first embodiment, and the same advantages can be obtained.

Fifth Embodiment

Next, description will be made regarding the configuration of a fifth embodiment of the image forming apparatus according to the present invention, with reference to FIG. 18. Note that configurations that are the same as with the above-described embodiments will be referred to by the same part names, regardless of whether denoted by the same reference numeral or different reference numerals, and description thereof will be omitted.

In the above fourth embodiment, positioning is performed using the rotation-regulated portions 108*g* and 108*f* that have cross-sectional elliptic shapes and protrude at both ends of the process cartridge Q1 in the longitudinal direction, as illustrated in FIG. 17. The rotation-regulated portions 108*g* and 108*f* position the rotational posture of the process cartridge Q1 within the mounting portion 113*f* of the extracting member 113 as to the LED unit 3.

In the present embodiment, a gripping portion 77 is provided on the first frame 208*a* of the photosensitive member unit 208 for the user to grasp the process cartridge R1 and mount to the mounting portion 113*f* of the extracting member 113. The first frame 208*a* has the rotation-regulated portions 208*g* and 208*f* that have cross-sectional elliptic shapes and protrude at both ends of the process cartridge R1 in the longitudinal direction. Other configurations and operations are the same as those in the above-described embodiments, so redundant description will be omitted.

Figure 18:
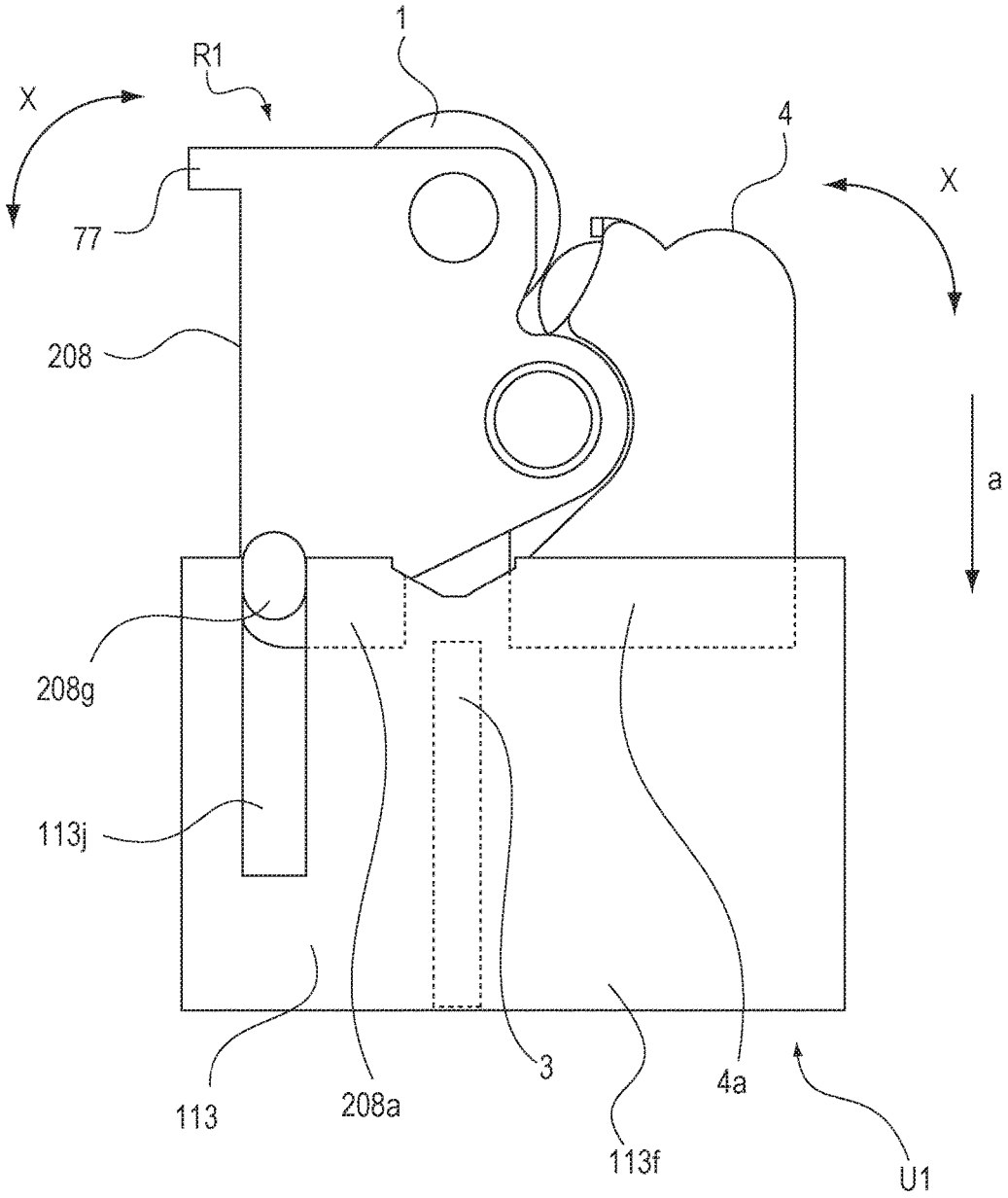
FIG. 18 is a cross-sectional explanatory diagram illustrating the cartridge of the image forming apparatus being mounted to the mounting portion of the supporting member.

As illustrated in FIG. 18, the process cartridge R1 according to the present embodiment uses the same developing unit 4 as in the first embodiment. On the other hand, the photosensitive member unit 208 is provided with the rotation-regulated portions 208*g* and 208*f* configured the same as the rotation-regulated portions 108*g* and 108*f* according to the fourth embodiment illustrated in FIG. 17.

Note that the rotation-regulated portion 208*f* is provided on the opposite side of the process cartridge R1 from the rotation-regulated portion 208*g* in the longitudinal direction in FIG. 18, and accordingly is not illustrated. Further, the gripping portion 77 is provided protruding at the corner of the top of the first frame 208*a* of the photosensitive member unit 208 according to the present embodiment.

The user grasps the gripping portion 77 to mount the process cartridge R1 in the mounting portion 113*f* of the extracting member 113. The gripping portion 77 is either integrally formed with the first frame 208*a*, or the gripping portion 77 is provided separately from and fixed to the first frame 208*a*. Accordingly, the distance between the rotation-regulated portions 208*g* and 208*f* provided to the first frame 208*a*, and the gripping portion 77, does not change.

In an arrangement where the gripping portion 77 is provided to the second frame 4*a* of the developing unit 4, and the rotation-regulated portions 208*g* and 208*f* are provided on the first frame 208*a* of the photosensitive member unit 208, the user grasps the gripping portion 77 and applies force to the gripping portion 77 provided to the second frame 4*a* of the developing unit 4 when mounting the process cartridge R1 to the mounting portion 113*f* of the extracting member 113. At this time, the distance between the rotation-regulated portions 208*g* and 208*f* provided to the first frame 208*a* of the photosensitive member unit 208, and the handle provided to the second frame 4*a* of the developing unit 4, 77 changes. As a result, the second frame 4*a* of the developing unit 4 of the process cartridge R1 may come into contact with the LED unit 3.

Accordingly, the gripping portion 77 and the rotation-regulated portions 208*g* and 208*f* are provided on the same first frame 208*a* in the present embodiment. The user grasps the gripping portion 77 and applies force to the gripping portion 77 provided to the first frame 208*a* of the photosensitive member unit 208 when mounting the process cartridge R1 to the mounting portion 113*f* of the extracting member 113. At this time, the distance between the rotation-regulated portions 208*g* and 208*f* provided to the first frame 208*a* of the photosensitive member unit 208 and the gripping portion 77 does not change. Consequently, there is no concern of the second frame 4*a* of the developing unit 4 of the process cartridge R1 coming into contact with the LED unit 3.

An example has been described in the present embodiment where the gripping portion 77 is provided to the first frame 208*a* of the photosensitive member unit 208, and the rotation-regulated portions 208*g* and 208*f* are provided to the first frame 208*a*, as illustrated in FIG. 18. Alternatively, the gripping portion 77 and the rotation-regulated portions may be provided to the second frame 4*a* of the developing unit 4. Other configurations are configured in the same way as in the above-described embodiments, and the same advantages can be obtained.

Although the process cartridges described in the above first through fifth embodiments are cartridges having the photosensitive drum 1, developing roller 40, and toner container 41, the cartridge configuration is not restricted to these. It is sufficient for the cartridges in the above first through fifth embodiments to have any one of the photosensitive drum 1 serving as a rotation member, the developing roller 40, and the toner container 41. In a configuration where the cartridge is not provided with the photosensitive drum 1, the extracting member 13 may be provided with the photosensitive drum 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2015-169954 and 2015-169955, filed Aug. 31, 2015, and Japanese Patent Application No. 2016-127170, filed Jun. 28, 2016, which are hereby incorporated by reference herein in their entirety.

What is claimed is:

1. An image forming apparatus comprising:

at least one cartridge including an image bearing member and a frame, the frame having at least two protruding portions protruding from an end of the frame; and a supporting member for supporting the at least one cartridge configured to move between an inside position situated inside a main unit of the image forming apparatus and an outside position situated outside of the main unit, the supporting member comprising:

a mounting portion to which the at least one cartridge is mountable along a direction orthogonal to an axial direction of the image bearing member;

a pair of opposing and parallel-oriented vertical sidewalls connected to opposing sides of the mounting portion;

at least one image exposing member, positioned between and orthogonal to the pair of opposing vertical sidewalls, configured to form a latent image on the image bearing member by emitting light from a light emitting surface toward the image bearing member, the at least one image exposing member protruding from a bottom of the supporting member and being inserted from an opening into the cartridge when the cartridge is mounted to the mounting portion;

at least two guide portions, each formed as a groove provided on each of the vertical sidewalls so that an open-side of the groove faces inward into the supporting member, configured to engage the at least two protruding portions to guide the at least one cartridge to move toward the mounting portion; and at least one regulating portion, formed in an upper edge of each of the vertical sidewalls, configured to regulate a rotation position of the cartridge when the at least two protruding portions are at a position in contact with the at least one regulating portion and not engaged with the at least two guide portions, the rotation having rotation axis which is parallel to the axial direction, wherein a gap is formed between (i) a part of a bottom surface of the frame which is opposed to the light emitting surface and (ii) the light emitting surface when the rotation position of the cartridge is regulated by the at least one regulating portion being in contact with the at least two protruding portions and is not engaged with the at least two guide portions in a state in which the opening is opposed to a plane perpendicular to protruding direction of the at least one image exposing member.

2. The image forming apparatus according to claim 1, wherein the at least two protruding portions and the at least one regulating portion each have planar portions that come into contact with each other.

3. The image forming apparatus according to claim 1, wherein, in a state where the at least one cartridge is mounted to the mounting portion, the at least two protruding portions are situated on both sides of an axial center point located where the image bearing member is rotatably fixed to the end of the frame, as viewed from each end of the frame.

4. The image forming apparatus according to claim 1, the at least two guide portions further comprising:

a rotation regulating portion configured to regulate a rotational posture of the at least one cartridge in a circumferential direction, in a state where the at least one cartridge is mounted to the mounting portion, wherein the at least two protruding portions are regulated by the rotation regulating portion and the rotational posture of the at least one cartridge in the circumferential direction is regulated.

5. The image forming apparatus according to claim 1, wherein the at least one cartridge includes a developing member configured to supply toner to the image bearing member.

6. The image forming apparatus according to claim 5, wherein the developing member is capable of moving between a position in contact with the image bearing member and a position separated from the image bearing member, in a state where the at least one cartridge is mounted to the mounting portion.

7. The image forming apparatus according to claim 1, wherein the at least one image exposing member includes a plurality of light emitting elements, arrayed in a rotational axis direction of the image bearing member.

* * * * *